US008377262B2

(12) United States Patent
Quigley

(10) Patent No.: US 8,377,262 B2
(45) Date of Patent: Feb. 19, 2013

(54) STRUCTURED PAPERMAKING FABRIC AND PAPERMAKING MACHINE

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 298 days.

(21) Appl. No.: 12/749,630

(22) Filed: Mar. 30, 2010

(65) Prior Publication Data

US 2010/0206507 A1 Aug. 19, 2010

Related U.S. Application Data

(63) Continuation of application No. PCT/EP2008/061121, filed on Aug. 26, 2008.

(60) Provisional application No. 61/077,223, filed on Jul. 1, 2008, provisional application No. 60/979,378, filed on Oct. 11, 2007.

(51) Int. Cl.

| | |
|---|---|
| ***D21F 1/10*** | (2006.01) |
| ***D21F 3/04*** | (2006.01) |
| ***D21F 9/00*** | (2006.01) |
| ***D21H 27/40*** | (2006.01) |
| ***D03D 25/00*** | (2006.01) |

(52) U.S. Cl. ..... 162/348; 162/116; 162/362; 162/902; 162/903; 162/206; 162/210; 162/358.1; 162/358.3; 139/383 A

(58) Field of Classification Search ..... 162/348, 162/902, 903, 904, 204–208, 210, 361, 362, 162/358.1, 358.3; 139/383 A, 425 A
See application file for complete search history.

(56) References Cited

U.S. PATENT DOCUMENTS

| | | | | |
|---|---|---|---|---|
| 4,191,609 | A | 3/1980 | Trokhan | |
| 5,429,686 | A | 7/1995 | Chiu | |
| 6,237,644 | B1 | 5/2001 | Hay | |
| 7,291,249 | B2 | 11/2007 | Thoroe-Scherb | |
| 7,351,307 | B2 | 4/2008 | Thoroe-Scherb | |
| 7,387,706 | B2 | 6/2008 | Herman | |
| 2005/0167066 | A1 * | 8/2005 | Herman et al. | 162/203 |

FOREIGN PATENT DOCUMENTS

| | | | |
|---|---|---|---|
| WO | WO 03/062528 | A1 | 7/2003 |
| WO | WO 2005/075732 | A2 | 8/2005 |
| WO | WO 2005/075736 | A2 | 8/2005 |
| WO | WO 2006/113818 | * | 10/2006 |

* cited by examiner

*Primary Examiner* — Eric Hug
(74) *Attorney, Agent, or Firm* — Taylor IP, P.C.

(57) ABSTRACT

A structured papermaking fabric for making a bulky tissue web, including: a web facing side and an opposite side, the web facing side including a structure formed by interweaving of transverse yarns with longitudinal yarns, the structure including a plurality of pattern areas being regularly distributed on the web facing side and each of said pattern area being surrounded by an edge area, said pattern areas are woven in a plain weave and each of said edge areas including at least one longitudinal and at least one transverse edge segment, said longitudinal edge segment being formed by weaving of a longitudinal yarn over at least four, preferably at least five, consecutive transverse yarns, said transverse edge segment being formed by weaving of a transverse yarn over at least four consecutive longitudinal yarns.

45 Claims, 14 Drawing Sheets

| | 1 S | 2 S | 3 S | 4 S | 5 S | 6 S | 7 S | 8 S | 9 S | 10 S |
|---|---|---|---|---|---|---|---|---|---|---|
| K16 | × | | × | | | | × | | | |
| K15 | | × | | | | | × | | | |
| K14 | | × | | | | × | | × | | |
| K13 | | × | | | × | | × | | × | |
| K12 | | × | | | | × | | × | | |
| K11 | | × | | | | | × | | | |
| K10 | × | | × | | | | × | | | |
| K9 | | × | | × | | | × | | | × |
| K8 | × | | × | | | | × | | | |
| K7 | | × | | | | | × | | | |
| K6 | | × | | | | × | | × | | |
| K5 | | × | | | × | | × | | × | |
| K4 | | × | | | | × | | × | | |
| K3 | | × | | | | | × | | | |
| K2 | × | | × | | | | × | | | |
| K1 | | × | | × | | | × | | | × |

STRUCTURED PAPERMAKING FABRIC AND PAPERMAKING MACHINE

CROSS REFERENCE TO RELATED APPLICATIONS

This is a continuation of PCT application No. PCT/EP2008/061121, entitled "STRUCTURED PAPERMAKING FABRIC AND PAPERMAKING MACHINE", filed Aug. 26, 2008, which claims priority to U.S. provisional patent application No. 61/077,223 entitled "STRUCTURED PAPERMAKING FABRIC AND PAPERMAKING MACHINE", filed Jul. 1, 2008 and U.S. provisional application No. 60/979,378 entitled "STRUCTURED PAPERMAKING FABRIC AND PAPERMAKING MACHINE", filed Oct. 11, 2007, which are each incorporated herein by reference.

BACKGROUND OF THE INVENTION

1. Field of the Invention

The present invention relates to a method of forming and processing a structured fiber web on a paper machine, and, more particularly, to a method and apparatus of forming and processing a structured fiber web on a structured forming fabric in a paper machine.

2. Description of the Related Art

In a wet molding process, a structured fabric in a Crescent Former configuration impresses a three dimensional surface on a web while the fibrous web is still wet. Such an invention is disclosed in International Publication No. WO 03/062528 A1. A suction box is disclosed for the purpose of shaping the fibrous web while wet to generate the three dimensional structure by removing air through the structural fabric. It is a physical displacement of portions of the fibrous web that leads to the three dimensional surface. Similar to the aforementioned method, a through air drying (TAD) technique is disclosed in U.S. Pat. No. 4,191,609. The TAD technique discloses how an already formed web is transferred and molded into an impression fabric. The transformation takes place on a web having a sheet solids level greater than 15%. This results in a low density pillow area in the fibrous web. These pillow areas are of a low basis weight since the already formed web is expanded to fill the valleys thereof. The impression of the fibrous web into a pattern, on an impression fabric, is carried out by passing a vacuum through the impression fabric to mold the fibrous web.

It is known to form a fiber web in a wet molding process using a structured fabric to impress a three dimensional surface on the web while the fibrous web is still wet. Such an invention is disclosed in International Publication No. WO 03/062528 A1. It is known to use forming fabrics, which have a load bearing layer and a sculptured layer wherein impression knuckles are formed, which imprint the sheet to increase the surface contour. Such an invention is disclosed in U.S. Pat. No. 5,429,686. However, this patent does not teach the creation of pillows on a sheet that are required for effective dewatering in through air drying (TAD) applications and in particular of an ATMOS™ papermaking machine. U.S. Pat. No. 6,237,644 teaches the use of fabrics, which are woven with a lattice pattern of at least three yarns oriented in both warp and weft. This reference teaches the use of a pattern fabric to provide shallow craters in distinct patterns. The physical displacement of portions of the fibrous web is a technique utilized to lead to a three-dimensional surface. A TAD technique is disclosed in U.S. Pat. No. 4,191,609. The TAD technique discloses how an already formed web is transferred and molded into an impression fabric. The transformation takes place on a web having a sheet solids level greater than 15%. This results in a low density pillow area in the fibrous web having a low basis weight, since the already formed web is expanded to fill the valleys. The impressions of the fibrous web into a pattern are carried out by passing a vacuum through the impression fabric to mold the fibrous web.

Prior art weave patterns such as the M weave illustrated in FIGS. 19-21 and the G weave shown in FIGS. 22-24 illustrate prior art fabrics that limit the amount of bulk that can be built into the fibrous web due to the shallow depth of the pockets. The weave patterns of the M weave and G weave are each based on a 5 by 5 pattern, which serves to define the location and shape of pockets. The pockets in these fabrics are shown as the darkened areas in FIGS. 19 and 22. These pockets are of such shape and depth that the bulk that can go therein is limited to less than a desired amount.

What is needed in the art is a structured forming fabric that will provide increased caliper, bulk and absorbency in tissue and toweling formed thereon.

SUMMARY OF THE INVENTION

According to a first and second aspect the present invention provides an improved structured papermaking fabric for forming and/or processing a fibrous web in a papermaking machine, said fibrous web having high basis weight pillow areas.

According to the first aspect of the invention there is provided a structured papermaking fabric for making a bulky tissue web, including: a web facing side and an opposite side, the web facing side including a structure formed by interweaving of transverse yarns with longitudinal yarns, the structure including a plurality of pattern areas being regularly distributed on the web facing side and each of said pattern areas being surrounded by an edge area, said pattern areas being woven in a plain weave and each of said edge areas including at least one longitudinal edge segment and at least one transverse edge segment, said longitudinal edge segment being formed by weaving of a longitudinal yarn over at least four, preferably at least five, consecutive transverse yarns, said transverse edge segment being formed by weaving of a transverse yarn over at least four consecutive longitudinal yarns.

According to the second aspect of the invention there is provided a structured papermaking fabric for making a bulky tissue web, including: a web facing side and an opposite side, the web facing side including a pattern formed by the weaving of transverse yarns with longitudinal yarns, said pattern being repeated in repeat units wherein per repeat unit:

- a first longitudinal yarn passes under a first transverse yarn, then passes over a second transverse yarn, then passes under a third, a fourth, a fifth, a sixth and a seventh transverse yarn, then passes over an eighth transverse yarn, then passes under a ninth transverse yarn, then passes over a tenth transverse yarn, then passes under an eleventh, a twelfth, a thirteenth, a fourteenth and a fifteenth transverse yarn before passing over a sixteenth transverse yarn,
- a second longitudinal yarn passes over the first transverse yarn, then passes under the second transverse yarn, then passes over the third, the fourth, the fifth, the sixth and the seventh transverse yarns, then passes under the eighth transverse yarn, then passes over the ninth transverse yarn, then passes under the tenth transverse yarn, then passes over the eleventh, the twelfth, the thirteenth, the fourteenth and the fifteenth transverse yarns before passing under the sixteenth transverse yarn, a third longitudinal yarn passes under the first transverse yarn, then passes over the second transverse yarn, then passes under the third, the fourth, the fifth, the sixth and the seventh transverse yarns, then passes over the eighth transverse yarn, then passes under the ninth transverse yarn, then passes over the tenth transverse yarn, then passes under the eleventh, the twelfth, the thirteenth, the fourteenth and the fifteenth transverse yarns before passing over the sixteenth transverse yarn, a fourth longitudinal yarn passes over the first transverse yarn, then passes under the second, the third, the fourth, the fifth, the sixth, the seventh and the eighth transverse yarns, then passes over the ninth transverse yarn before passing under the tenth, the eleventh, the twelfth, the thirteenth, the fourteenth, the fifteenth and sixteenth transverse yarns, a fifth longitudinal yarn passes under the first, the second, the third and the fourth transverse yarns, then passes over the fifth transverse yarn, then passes under the sixth, the seventh, the eighth, the ninth, the tenth, the eleventh and the twelfth transverse yarns, then passes over the thirteenth transverse yarn before passing under the fourteenth, the fifteenth and sixteenth transverse yarns, a sixth longitudinal yarn passes under the first, the second and the third transverse yarns, then passes over the fourth transverse yarn, then passes under the fifth transverse yarn, then passes over the sixth transverse yarn, then passes under the seventh, the eighth, the ninth, the tenth, the eleventh transverse yarns, then passes over the twelfth transverse yarn, then passes under the thirteenth transverse yarn, then passes over the fourteenth transverse yarn before passing under the fifteenth and the sixteenth transverse yarns, a seventh longitudinal yarn passes over the first, the second and the third transverse yarns, then passes under the fourth transverse yarn, then passes over the fifth transverse yarn, then passes under the sixth transverse yarn, then passes over the seventh, the eighth, the ninth, the tenth, and the eleventh transverse yarns, then passes under the twelfth transverse yarn, then passes over the thirteenth transverse yarn, then passes under the fourteenth transverse yarn before passing over the fifteenth and the sixteenth transverse yarns, an eighth longitudinal yarn passes under the first, the second and the third transverse yarns, then passes over the fourth transverse yarn, then passes under the fifth transverse yarn, then passes over the sixth transverse yarn, then passes under the seventh, the eighth, the ninth, the tenth, and the eleventh transverse yarns, then passes over the twelfth transverse yarn, then passes under the thirteenth transverse yarn, then passes over the fourteenth transverse yarn before passing under the fifteenth and the sixteenth transverse yarns, a ninth longitudinal yarn passes under the first, the second, the third and the fourth transverse yarns, then passes over the fifth transverse yarn, then passes under the sixth, the seventh, the eighth, the ninth, the tenth, the eleventh and the twelfth transverse yarns, then passes over the thirteenth transverse yarn before passing under the fourteenth, the fifteenth and the sixteenth transverse yarns, a tenth longitudinal yarn passes over the first transverse yarn, then passes under the second, the third, the fourth, the fifth, the sixth, the seventh and the eighth transverse yarns, then passes over the ninth transverse yarn before passing under the tenth, the eleventh, the twelfth, the thirteenth, the fourteenth, the fifteenth and sixteenth transverse yarns.

The present invention further provides a method of producing a structured fibrous web having a high basis weight pillow area on a paper machine using the structured papermaking fabric of the first and second aspect of the present invention.

In addition the present invention provides an apparatus for making a structured fibrous web having a high basis weight pillow area, said machine including the structured papermaking of the first and second aspect of the present invention.

An advantage of the present invention is that the structured papermaking fabric has pockets formed by the pattern areas for the manufacture of bulky tissue.

Another advantage of the present invention is that it creates an improved surface area on a bulky tissue sheet and improved machine performance in making the tissue sheet.

Yet another advantage of the present invention is the perfect formation with high density pillow areas using the ATMOS™ concept, where the forming of the sheet takes place on the structured fabric.

BRIEF DESCRIPTION OF THE DRAWINGS

The above mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

Figure 1:
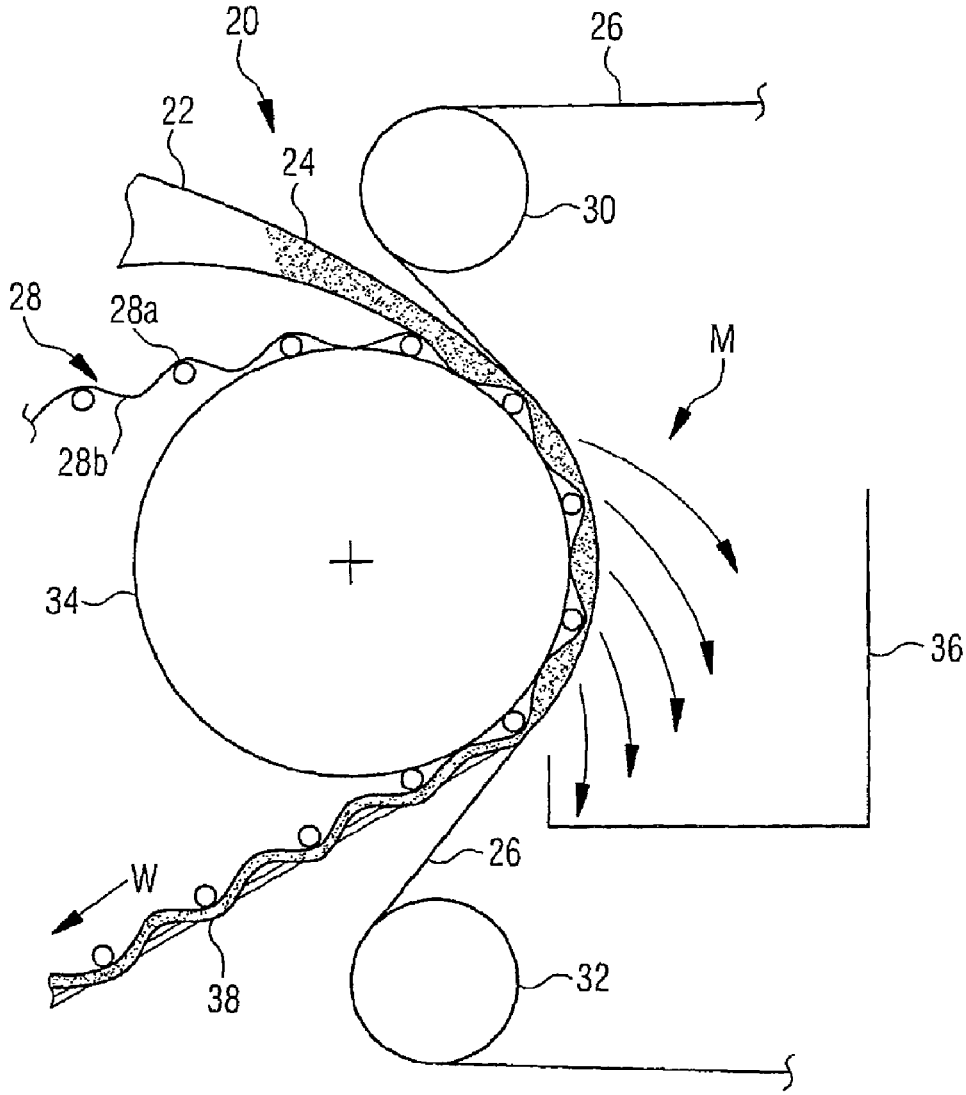
FIG. 1 is a cross-sectional schematic diagram illustrating the formation of a structured web using an embodiment of a method of the present invention.

Referring now to the drawings, and more particularly to FIG. 1, there is a fibrous web machine 20 including a headbox 22 that discharges a fibrous slurry 24 between a forming fabric 26 and a structured fabric 28. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, structured fibrous web 38 takes form. Moisture M that leaves slurry 24 travels through forming fabric 26 and is collected in save-all 36. Fibers in fibrous slurry 24 collect predominately in valleys 28*b* as web 38 takes form.

Structured fabric 28 includes warp and weft yarns interwoven on a textile loom. Structured fabric 28 may be woven flat or in an endless form. The final mesh count of structured fabric 28 lies between 95×120 and 26×20. For the manufacture of toilet tissue, the preferred mesh count is 51×36 or higher and more preferably 58×44 or higher. For the manufacture of paper towels, the preferred mesh count is 42×31 or lower, and more preferably 36×30 or lower. Structured fabric 28 may have a repeated pattern of 4 shed and above repeats, preferably 5 shed or greater repeats. The warp yarns of structured fabric 28 have diameters of between 0.12 mm and 0.70 mm, and weft yarns have diameters of between 0.15 mm and 0.60 mm. The pocket depth, which is the offset between peak 28*a* and valley 28*b*, is between approximately 0.07 mm and 0.60 mm. Yarns utilized in structured fabric 28 may be of any cross-sectional shape, for example, round, oval or flat. The yarns of structured fabric 28 can be made of thermoplastic or thermoset polymeric materials of any color. The surface of structured fabric 28 can be treated to provide a desired surface energy, thermal resistance, abrasion resistance and/or hydrolysis resistance. A printed design, such as a screen printed design, of polymeric material can be applied to structured fabric 28 to enhance its ability to impart an aesthetic pattern into web 38 or to enhance the quality of web 38. Such a design may be in the form of an elastomeric cast structure similar to the Spectra® membrane described in another patent application. Structured fabric 28 has a top surface plane contact area at peak 28*a* of 10% or higher, preferably 20% or higher, and more preferably 30% depending upon the particular product being made. The contact area on structured web 28 at peak 28*a* can be increased by abrading the top surface of structured fabric 28 or an elastomeric cast structure can be formed thereon having a flat top surface. The top surface may also be hot calendered to increase the flatness.

Forming roll 34 is preferably solid. Moisture travels through forming fiber 26 but not through structured fabric 28. This advantageously forms structured fibrous web 38 into a more bulky or absorbent web than the prior art.

Figure 2:
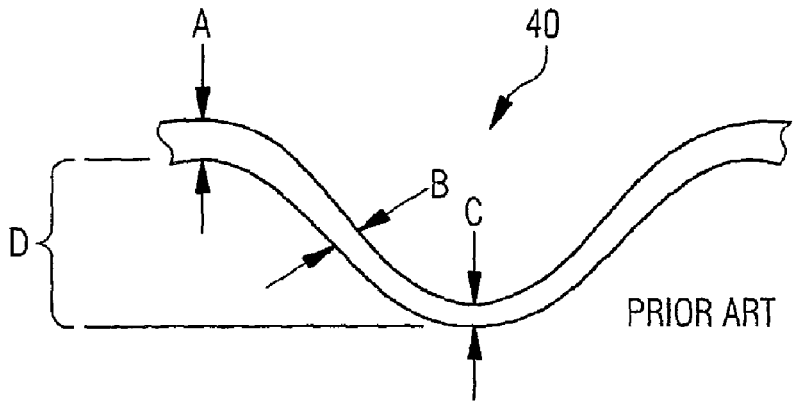
FIG. 2 is a cross-sectional view of a portion of a structured web of a prior art method.

Prior art methods of moisture removal, remove moisture through a structured fabric by way of negative pressure. It results in a cross-sectional view as seen in FIG. 2. Prior art structured web 40 has a pocket depth D which corresponds to the dimensional difference between a valley and a peak. The valley occurring at the point where measurement C occurs and the peak occurring at the point where measurement A is taken. A top surface thickness A is formed in the prior art method. Sidewall dimension B and pillow thickness C of the prior art result from moisture drawn through a structured fabric. Dimension B is less than dimension A and dimension C is less than dimension B in the prior art structure.

Figure 3:
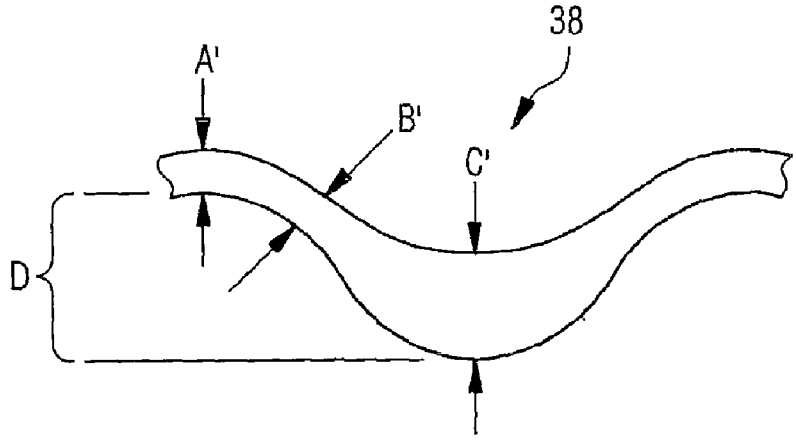
FIG. 3 is a cross-sectional view of a portion of the structured web of an embodiment of the present invention as made on the machine of FIG. 1.
Figure 4:
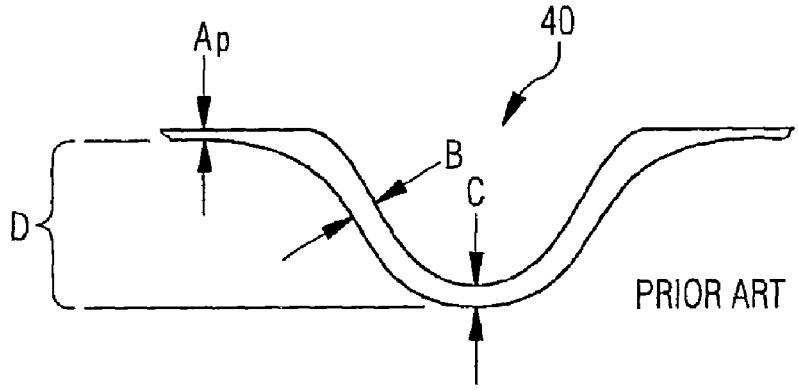
FIG. 4 illustrates the web portion of FIG. 2 having subsequently gone through a press drying operation.
Figure 5:
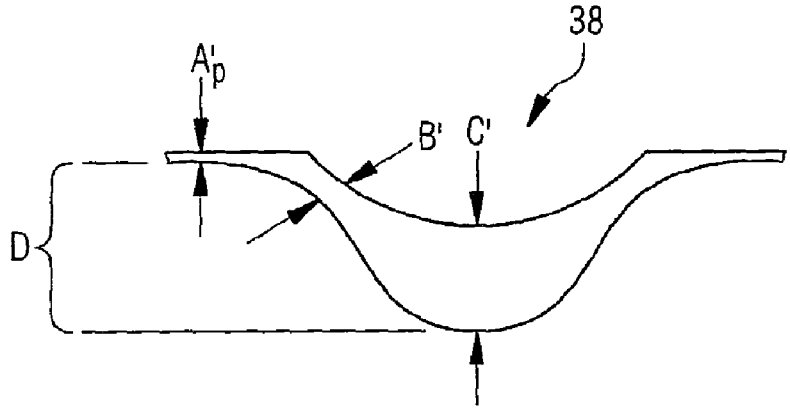
FIG. 5 illustrates a portion of the fiber web of the present invention of FIG. 3 having subsequently gone through a press drying operation.

In contrast, structured web 38, as illustrated in FIGS. 3 and 5, have for discussion purposes, a pocket depth D that is similar to the prior art. However, sidewall thickness B' and pillow thickness C' exceed the comparable dimensions of web 40. This advantageously results from the forming of structural web 38 on structured fabric 28 at low consistency and the removal of moisture is an opposite direction from the prior art. This results in a thicker pillow dimension C'. Even after fiber web 38 goes through a drying press operation, as illustrated in FIG. 5, dimension C' is substantially greater than $A_p$'. Advantageously, the fiber web resulting from the present invention has a higher basis weight in the pillow areas as compared to prior art. Also, the fiber to fiber bonds are not broken as they can be in impression operations, which expand the web into the valleys.

According to prior art an already formed web is vacuum transferred into a structured fabric. The sheet must then expand to fill the contour of the structured fabric. In doing so, fibers must move apart. Thus the basis weight is lower in these pillow areas and therefore the thickness is less than the sheet at point A.

Now, referring to FIGS. 6 to 11 the process will be explained by simplified schematic drawings.

Figure 6:
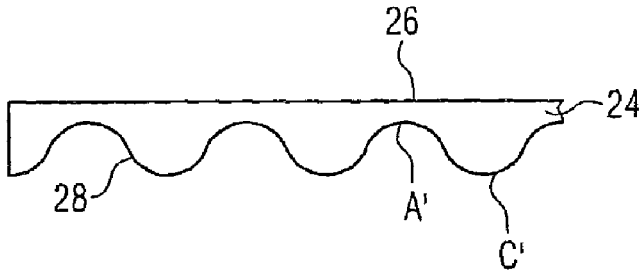
FIG. 6 illustrates a resulting fiber web of the forming section of the present invention.
Figure 8:
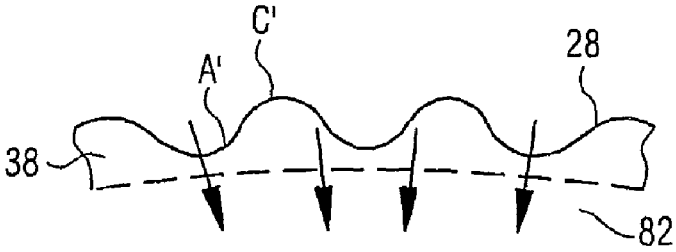
PRIOR ART Fig.8
FIG. 8 illustrates the moisture removal of the fiber web of the present invention.

As shown in FIG. 6, fibrous slurry 24 is formed into a web 38 with a structure inherent in the shape of structured fabric 28. Forming fabric 26 is porous and allows moisture to escape during forming. Further, water is removed as shown in FIG. 8, through dewatering fabric 82. The removal of moisture through fabric 82 does not cause a compression of pillow areas C' in the forming web, since pillow areas C' reside in the structure of structured fabric 28.

Figure 7:
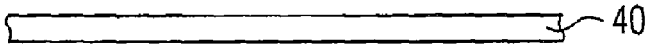
FIG. 7 illustrates the resulting fiber web of the forming section of a prior art method.

The prior art web shown in FIG. 7, is formed with a conventional forming fabric as between two conventional forming fabrics in a twin wire former and is characterized by a flat uniform surface. It is this fiber web that is given a three-dimensional structure by a wet shaping stage, which results in the fiber web that is shown in FIG. 2. A conventional tissue machine that employs a conventional press fabric will have a contact area approaching 100%. Normal contact area of the structured fiber, as in this present invention, or as on a TAD machine, is typically much lower than that of a conventional machine; it is in the range of 15 to 35% depending on the particular pattern of the product being made.

Figure 9:
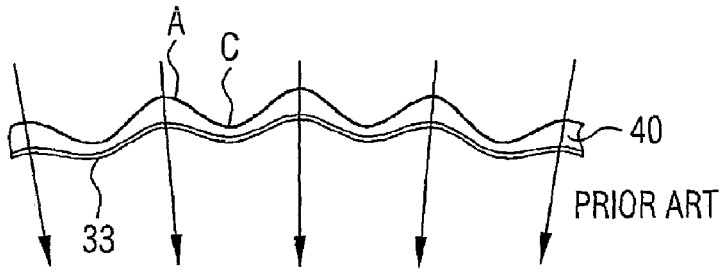
FIG. 9 illustrates the moisture removal of the fiber web of a prior art structured web.
Figure 10:
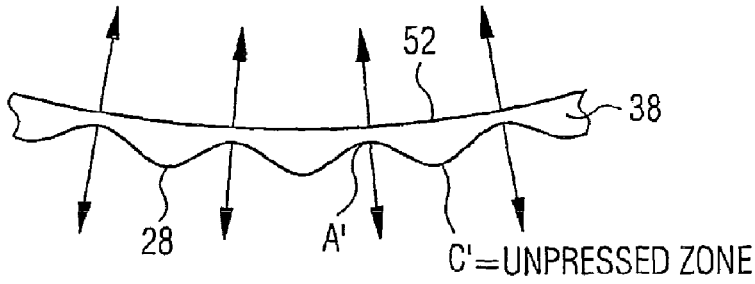
FIG. 10 illustrates the pressing points on a fiber web of the present invention.
Figure 11:
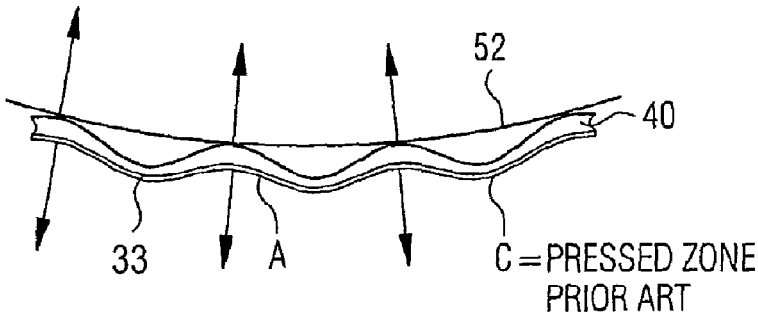
FIG. 11 illustrates pressing points of prior art structured web.

In FIGS. 9 and 11 a prior art web structure is shown where moisture is drawn through a structured fabric 33 causing the web, as shown in FIG. 7, to be shaped and causing pillow area C to have a low basis weight as the fibers in the web are drawn into the structure. The shaping can be done by performing pressure or underpressure to the web 40 forcing the web to follow the structure of the structured fabric 33. This additionally causes fiber tearing as they are moved into pillow area C. Subsequent pressing at the Yankee dryer 52, as shown in FIG. 11, further reduces the basis weight in area C. In contrast, water is drawn through dewatering fabric 82 in the present invention, as shown in FIG. 8, preserving pillow areas C'. Pillow areas C' of FIG. 10, is an unpressed zone, which is supported on structured fabric 28, while pressed against Yankee 52. Pressed zone A' is the area through which most of the pressure applied is transferred. Pillow area C' has a higher basis weight than that of the illustrated prior art structures.

The increased mass ratio of the present invention, particularly the higher basis weight in the pillow areas carries more water than the compressed areas, resulting in at least two positive aspects of the present invention over the prior art, as illustrated in FIGS. 10 and 11. First, it allows for a good transfer of the web to the Yankee surface 52, since the web has a relatively lower basis weight in the portion that comes in contact with the Yankee surface 52, at a lower overall sheet solid content than had been previously attainable, because of the lower mass of fibers that comes in contact with the Yankee dryer 52. The lower basis weight means that less water is carried to the contact points with the Yankee dryer 52. The compressed areas are dryer than the pillow areas, thereby allowing an overall transfer of the web to another surface, such as a Yankee dryer 52, with a lower overall web solids content. Secondly, the construct allows for the use of higher temperatures in the Yankee hood 54 without scorching or burning of the pillow areas, which occurs in the prior art pillow areas. The Yankee hood 54 temperatures are often greater than 350° C. and preferably greater than 450° C. and even more preferably greater than 550° C. As a result the present invention can operate at lower average pre-Yankee press solids than the prior art, making more full use of the capacity of the Yankee Hood drying system. The present invention can allow the solids content of web 38 prior to the Yankee dryer to run at less than 40%, less than 35% and even as low as 25%.

Due to the formation of the web 38 with the structured fabric 28 the pockets of the fabric 28 are fully filled with fibers.

Therefore, at the Yankee surface 52 the web 38 has a much higher contact area, up to approx. 100%, as compared to the prior art because the web 38 on the side contacting the Yankee surface 52 is almost flat. At the same time the pillow areas C' of the web 38 maintain unpressed, because they are protected by the valleys of the structured fabric 28 (FIG. 10). Good results in drying efficiency were obtained only pressing 25% of the web.

As can be seen in FIG. 11 the contact area of the prior art web 40 to the Yankee surface 52 is much lower as compared to the one of the web 38 manufactured according to the invention.

The lower contact area of the prior art web 40 results from the shaping of the web 40 that now follows the structure of the structured fabric 33.

Due to the less contact area of the prior art web 40 to the Yankee surface 52 the drying efficiency is less.

Figure 12:
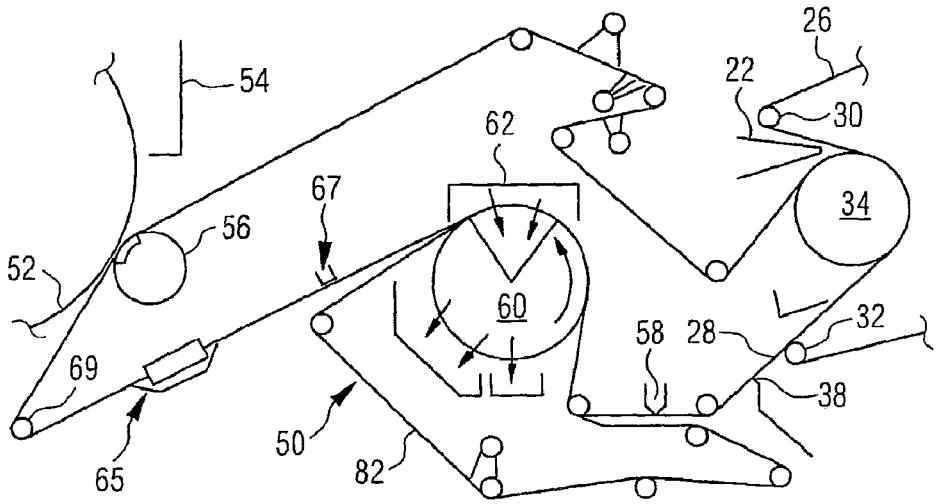
FIG. 12 illustrates a schematical cross-sectional view of an embodiment of a papermaking machine of the present invention.

Now, additionally referring to FIG. 12, there is shown an embodiment of the process where a structured fiber web 38 is formed. Structured fabric 28 carries a three dimensional structured web 38 to an advanced dewatering system 50, past suction box 67 and then to a Yankee roll 52 where the web is transferred to Yankee roll 52 and hood section 54 for additional drying and creping before winding up on a reel (not shown).

A shoe press 56 is placed adjacent to structured fabric 28, holding it in a position proximate Yankee roll 52. Structured web 38 comes into contact with Yankee roll 52 and transfers to a surface thereof, for further drying and subsequent creping.

A vacuum box 58 is placed adjacent to structured fabric 28 to achieve a solids level of 15-25% on a nominal 20 gsm web running at −0.2 to −0.8 bar vacuum with a preferred operating level of −0.4 to −0.6 bar. Web 38, which is carried by structured fabric 28, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering. If for example, a commercial Yankee drying cylinder with 44 mm steel thickness and a conventional hood with an air blowing speed of 145 m/s is used production speeds of 1400 m/min or more for towel paper and 1700 m/min or more for toilet paper are used.

Optionally a steam box can be installed instead of the hood 62 supplying steam to the web 38. Preferably the steam box has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee roll 52. Wire turning roll 69 can also be a suction roll with a hot air supply hood. Roll 56 includes a shoe press with a shoe width of 80 mm or higher, preferably 120 mm or higher, with a maximum peak pressure of less than 2.5 MPa. To create an even longer nip to facilitate the transfer of web 38 to Yankee 52, web 38 carried on structured fabric 28 can be brought into contact with the surface of Yankee roll 52 prior to the press nip associated with shoe press 56. Further, the contact can be maintained after structured fabric 28 travels beyond press 56.

Dewatering fabric 82 may have a permeable woven base fabric connected to a batt layer. The base fabric includes machine direction yarns and cross-directional yarns. The machine direction yarn is a 3 ply multifilament twisted yarn. The cross-direction yarn is a monofilament yarn. The machine direction yarn can also be a monofilament yarn and the construction can be of a typical multilayer design. In either case, the base fabric is needled with a fine batt fiber having a weight of less than or equal to 700 gsm, preferably less than or equal to 150 gsm and more preferably less than or equal to 135 gsm. The batt fiber encapsulates the base structure giving it sufficient stability. The needling process can be such that straight through channels are created. The sheet contacting surface is heated to improve its surface smoothness s. The cross-sectional area of the machine direction yarns is larger than the cross-sectional area of the cross-direction yarns. The machine direction yarn is a multifilament yarn that may include thousands of fibers. The base fabric is connected to a batt layer by a needling process that results in straight through drainage channels.

In another embodiment of dewatering fabric 82 there is included a fabric layer, at least two batt layers, an anti-rewetting layer and an adhesive. The base fabric is substantially similar to the previous description. At least one of the batt layers includes a low melt bi-compound fiber to supplement fiber to fiber bonding upon heating. On one side of the base fabric, there is attached an anti-rewetting layer, which may be attached to the base fabric by an adhesive, a melting process or needling wherein the material contained in the anti-rewet layer is connected to the base fabric layer and a batt layer. The anti-rewetting layer is made of an elastomeric material thereby forming elastomeric membrane, which has openings therethrough.

The batt layers are needled to thereby hold dewatering fabric 82 together. This advantageously leaves the batt layers with many needled holes therethrough. The anti-rewetting layer is porous having water channels or straight-through pores therethrough.

In yet another embodiment of dewatering fabric 82, there is a construct substantially similar to that previously discussed with an addition of a hydrophobic layer to at least one side of de-watering fabric 82. The hydrophobic layer does not absorb water, but it does direct water through pores therein.

In yet another embodiment of dewatering fabric 82, the base fabric has attached thereto a lattice grid made of a polymer, such as polyurethane, that is put on top of the base fabric. The grid may be put on to the base fabric by utilizing various known procedures, such as, for example, an extrusion technique or a screen-printing technique. The lattice grid may be put on the base fabric with an angular orientation relative to the machine direction yarns and the cross direction yarns. Although this orientation is such that no part of the lattice is aligned with the machine direction yarns, other orientations can also be utilized. The lattice can have a uniform grid pattern, which can be discontinuous in part. Further, the material between the interconnections of the lattice structure may take a circuitous path rather than being substantially straight. The lattice grid is made of a synthetic, such as a polymer or specifically a polyurethane, which attaches itself to the base fabric by its natural adhesion properties.

In yet another embodiment of dewatering fabric 82 there is included a permeable base fabric having machine direction yarns and cross-direction yarns that are adhered to a grid. The grid is made of a composite material that may be the same as that discussed relative to a previous embodiment of dewatering fabric 82. The grid includes machine direction yarns with a composite material formed therearound. The grid is a composite structure formed of composite material and machine direction yarns. The machine direction yarns may be precoated with a composite before being placed in rows that are substantially parallel in a mold that is used to reheat the composite material causing it to re-flow into a pattern. Additional composite material may be put into the mold as well. The grid structure, also known as a composite layer, is then connected to the base fabric by one of many techniques including laminating the grid to the permeable fabric, melting the composite coated yarn as it is held in position against the permeable fabric or by re-melting the grid onto the base fabric. Additionally, an adhesive may be utilized to attach the grid to permeable fabric.

The batt fiber may include two layers, an upper and a lower layer. The batt fiber is needled into the base fabric and the composite layer, thereby forming a dewatering fabric 82 having at least one outer batt layer surface. Batt material is porous by its nature, additionally the needling process not only connects the layers together, but it also creates numerous small porous cavities extending into or completely through the structure of dewatering fabric 82.

Dewatering fabric 82 has an air permeability of from 5 to 100 cubic feet/minute preferably 19 cubic feet/minute or higher and more preferably 35 cubic feet/minute or higher. Mean pore diameters in dewatering fabric 82 are from 5 to 75 microns, preferably 25 microns or higher and more preferably 35 microns or higher. The hydrophobic layers can be made from a synthetic polymeric material, a wool or a polyamide, for example, nylon 6. The anti-rewet layer and the composite layer may be made of a thin elastomeric permeable membrane made from a synthetic polymeric material or a polyamide that is laminated to the base fabric.

The batt fiber layers are made from fibers ranging from 0.5 d-tex to 22 d-tex and may contain a low melt bi-compound fiber to supplement fiber to fiber bonding in each of the layers upon heating. The bonding may result from the use of a low temperature meltable fiber, particles and/or resin. The dewatering fabric can be less than 2.0 millimeters, or less than 1.50 millimeters, or less than 1.25 millimeters or less than 1.0 millimeter thick.

Preferred embodiments of the dewatering fabric 82 are also described in the PCT/EP2004/053688 and PCT/EP2005/050198 which are herewith incorporated by reference.

Figure 13:
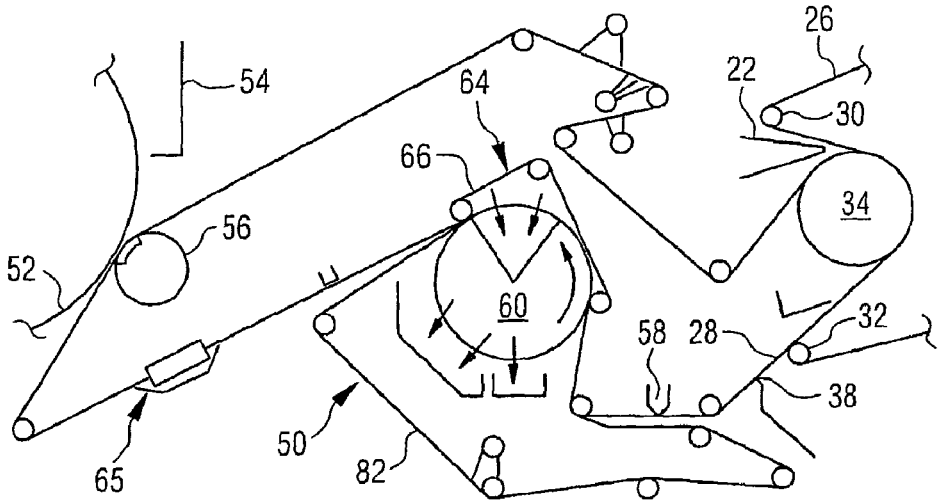
FIG. 13 illustrates a schematical cross-sectional view of another embodiment of a papermaking machine of the present invention.

Now, additionally referring to FIG. 13, there is shown yet another embodiment of the present invention, which is substantially similar to the invention illustrated in FIG. 12, except that instead of hot air hood 62, there is a belt press 64. Belt press 64 includes a permeable belt 66 capable of applying pressure to the non-sheet contacting side of structured fabric 28 that carries web 38 around suction roll 60. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conciliation are also described in PCT/EP2004/053688 and PCT/EP2005/050198 which are herewith incorporated by reference.

The above mentioned references are also fully applicable for dewatering fabrics 82 and press fabrics 66 described in the further embodiments.

While pressure is applied to structured fabric 28, the high fiber density pillow areas in web 38 are protected from that pressure as they are contained within the body of structured fabric 28, as they are in the Yankee nip.

Belt 66 is a specially designed Extended Nip Press Belt 66, made of, for example reinforced polyurethane and/or a spiral link fabric. Belt 66 is permeable thereby allowing air to flow therethrough to enhance the moisture removing capability of belt press 64. Moisture is drawn from web 38 through dewatering fabric 82 and into vacuum roll 60.

Belt 66 provides a low level of pressing in the range of 50-300 KPa and preferably greater than 100 KPa. This allows a suction roll with a 1.2 meter diameter to have a fabric tension of greater than 30 KN/m and preferably greater than 60 KN/m. The pressing length of permeable belt 66 against fabric 28, which is indirectly supported by vacuum roll 60, is at least as long as a suction zone in roll 60. Although the contact portion of belt 66 can be shorter than the suction zone.

Permeable belt 66 has a pattern of holes therethrough, which may, for example, be drilled, laser cut, etched formed or woven therein. Permeable belt 66 may be monoplanar without grooves. In one embodiment, the surface of belt 66 has grooves and is placed in contact with fabric 28 along a portion of the travel of permeable belt 66 in belt press 64. Each groove connects with a set of the holes to allow the passage and distribution of air in belt 66. Air is distributed along the grooves, which constitutes an open area adjacent to contact areas, where the surface of belt 66 applies pressure against web 38. Air enters permeable belt 66 through the holes and then migrates along the grooves, passing through fabric 28, web 38 and fabric 82. The diameter of the holes may be larger than the width of the grooves. The grooves may have a cross-section contour that is generally rectangular, triangular, trapezoidal, semi-circular or semi-elliptical. The combination of permeable belt 66, associated with vacuum roll 60, is a combination that has been shown to increase sheet solids by at least 15%.

An example of another structure of belt 66 is that of a thin spiral link fabric, which can be a reinforcing structure within belt 66 or the spiral link fabric will itself serve as belt 66. Within fabric 28 there is a three dimensional structure that is reflected in web 38. Web 38 has thicker pillow areas, which are protected during pressing as they are within the body of structured fabric 28. As such the pressing imparted by belt press assembly 64 upon web 38 does not negatively impact web quality, while it increases the dewatering rate of vacuum roll 60.

Figure 14:
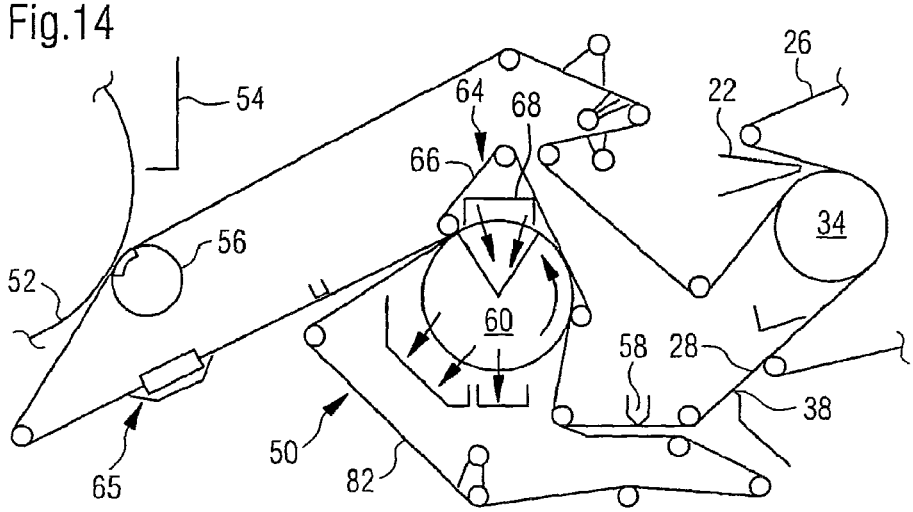
FIG. 14 illustrates a schematical cross-sectional view of another embodiment of a papermaking machine of the present invention.

Now, additionally referring to FIG. 14, which is substantially similar to the embodiment shown in FIG. 13 with the addition of hot air hood 68 placed inside of belt press 64 to enhance the dewatering capability of belt press 64 in conjunction with vacuum roll 60.

Figure 15:
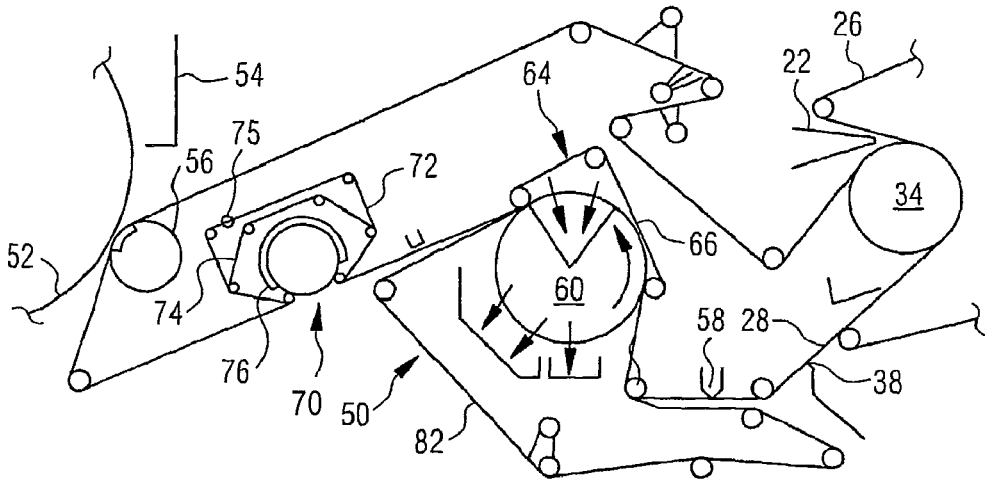
FIG. 15 illustrates a schematical cross-sectional view of another embodiment of a papermaking machine of the present invention.

Now, additionally referring to FIG. 15, there is shown yet another embodiment of the present invention, which is substantially similar to the embodiment shown in FIG. 13, but including a boost dryer 70, which encounters structured fabric 28. Web 38 is subjected to a hot surface of boost driver 70. Structured web 38 rides around boost dryer 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. Here again, the higher fiber density pillow areas in web 38 are protected from the pressure as they are contained within the body of structured fabric 28. As such, the pressing process does not negatively impact web quality. The drying rate of boost dryer 70 is above 400 kg/hrm$^2$ and preferably above 500 kg/hrm$^2$. The concept of boost dryer 70 is to provide sufficient pressure to hold web 38 against the hot surface of the dryer thus preventing blistering. Steam that is formed at the knuckle points fabric 28 passes through fabric 28 and is condensed on fabric 72. Fabric 72 is cooled by fabric 74 that is in contact with the cooling jacket, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending upon the size of boost dryer 70, web 38 may be creped on the surface of boost dryer 70, thereby eliminating the need for Yankee dryer 52.

Figure 16:
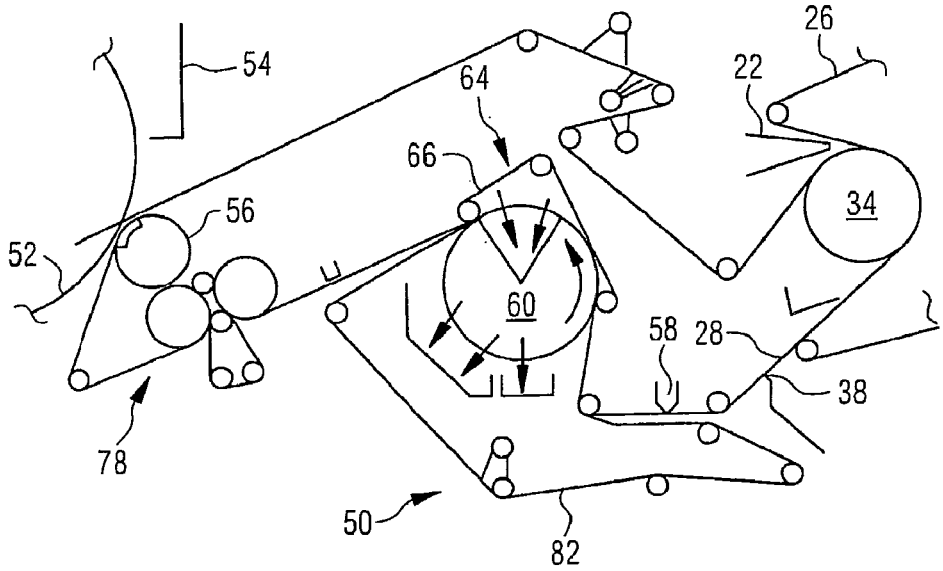
FIG. 16 illustrates a schematical cross-sectional view of another embodiment of a papermaking machine of the present invention.

Now, additionally referring to FIG. 16, there is shown yet another embodiment of the present invention substantially similar to the invention disclosed in FIG. 13 but with an addition of an air press 78, which is a four roll cluster press that is used with high temperature air and is referred to as an HPTAD for additional web drying prior to the transfer of web 38 to Yankee 52. Four roll cluster press 78 includes a main roll and a vented roll and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high pressure hot air passes through an optional air dispersion fabric, through web 38 and fabric 28 into a vent roll. The air dispersion fabric may prevent web 38 from following one of the four cap rolls. The air dispersion fabric is very open, having a permeability that equals or exceeds that of fabric 28. The drying rate of the HPTAD depends on the solids content of web 38 as it enters the HPTAD. The preferred drying rate is at least 500 kg/hr/m$^2$, which is a rate of at least twice that of conventional TAD machines.

Advantages of the HPTAD process are in the areas of improved sheet dewatering without a significant loss in sheet quality, compactness in size and energy efficiency. Additionally, it enables higher pre-Yankee solids, which increase the speed potential of the invention. Further, the compact size of the HPTAD allows for easy retrofit to an existing machine. The compact size of the HPTAD and the fact that it is a closed system means that it can be easily insulated and optimized as a unit to increase energy efficiency.

Figure 17:
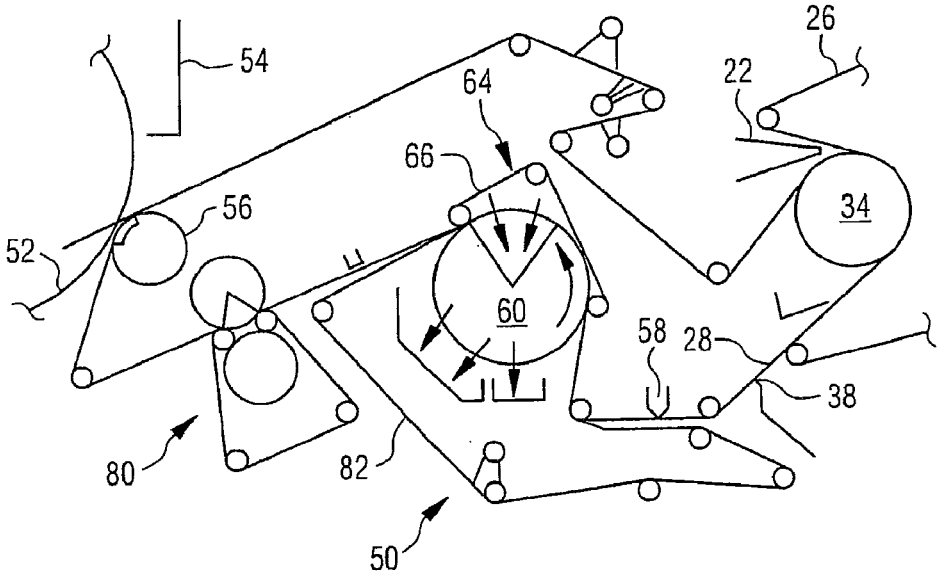
FIG. 17 illustrates a schematical cross-sectional view of another embodiment of a papermaking machine of the present invention.

Now, additionally referring to FIG. 17, there is shown another embodiment of the present invention. This is significantly similar to FIGS. 13 and 16 except for the addition of a two-pass HPTAD 80. In this case, two vented rolls are used to double the dwell time of structured web 38 relative to the design shown in FIG. 16. An optional coarse mesh fabric may used as in the previous embodiment. Hot pressurized air passes through web 38 carried on fabric 28 and onto the two vent rolls. It has been shown that depending on the configuration and size of the HPTAD, that more than one HPTAD can be placed in series, which can eliminate the need for roll 60.

Figure 18:
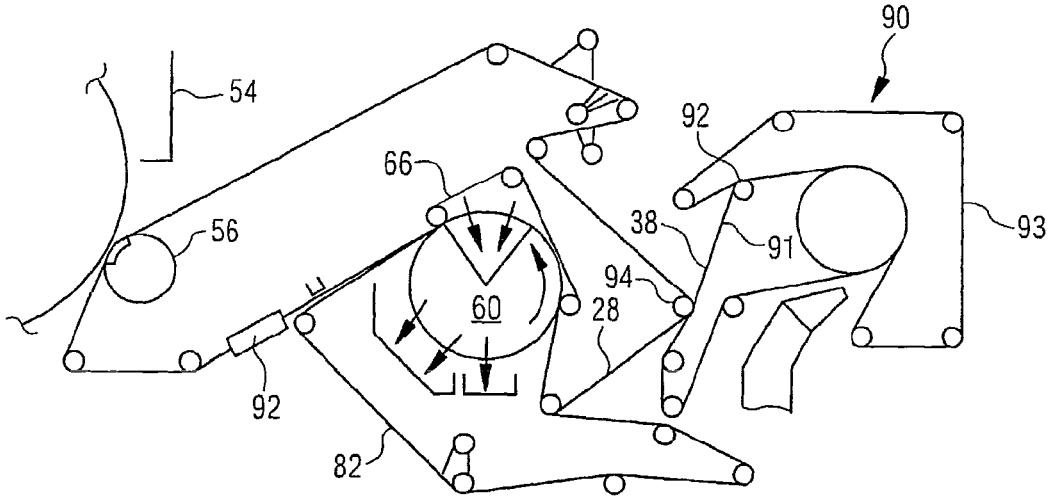
FIG. 18 illustrates a schematical cross-sectional view of another embodiment of a papermaking machine of the present invention.
Figure 19:
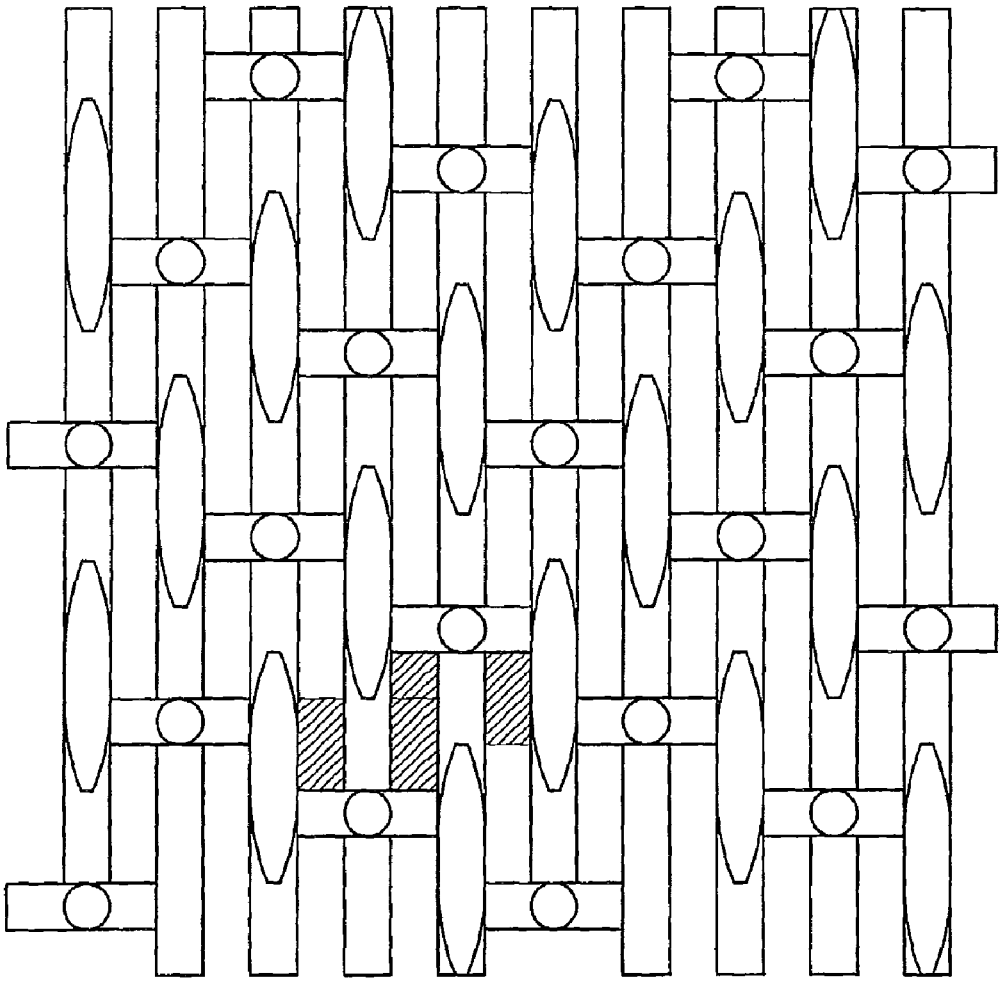
FIG. 19 is a prior art woven fabric known as an M weave fabric.
Figure 20:
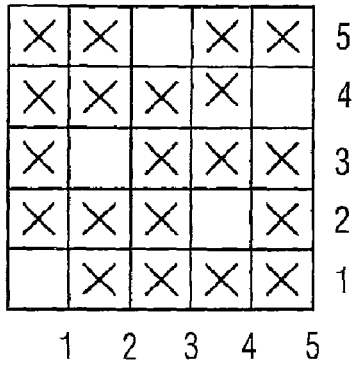
FIG. 20 is a schematical view of the positioning of the weft and warp yarns of the woven fabric of FIG. 19.
Figure 21:
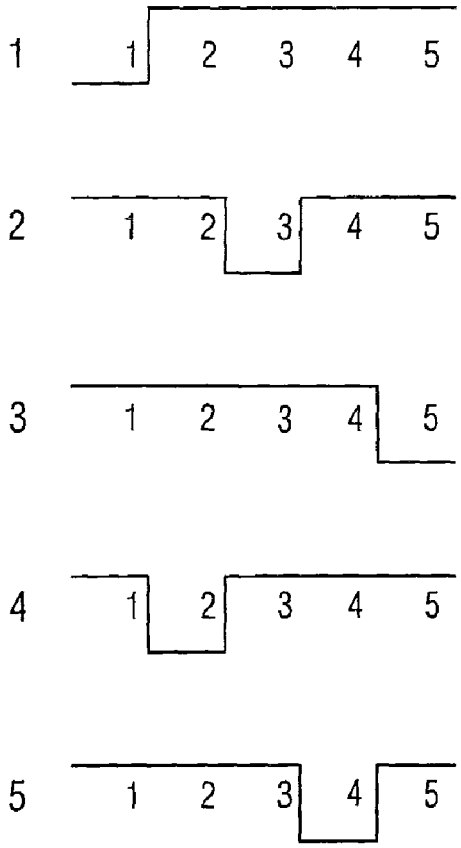
FIG. 21 is a schematical representation of the routing of the warp yarns of the woven fabric of FIGS. 19 and 20.
Figure 22:
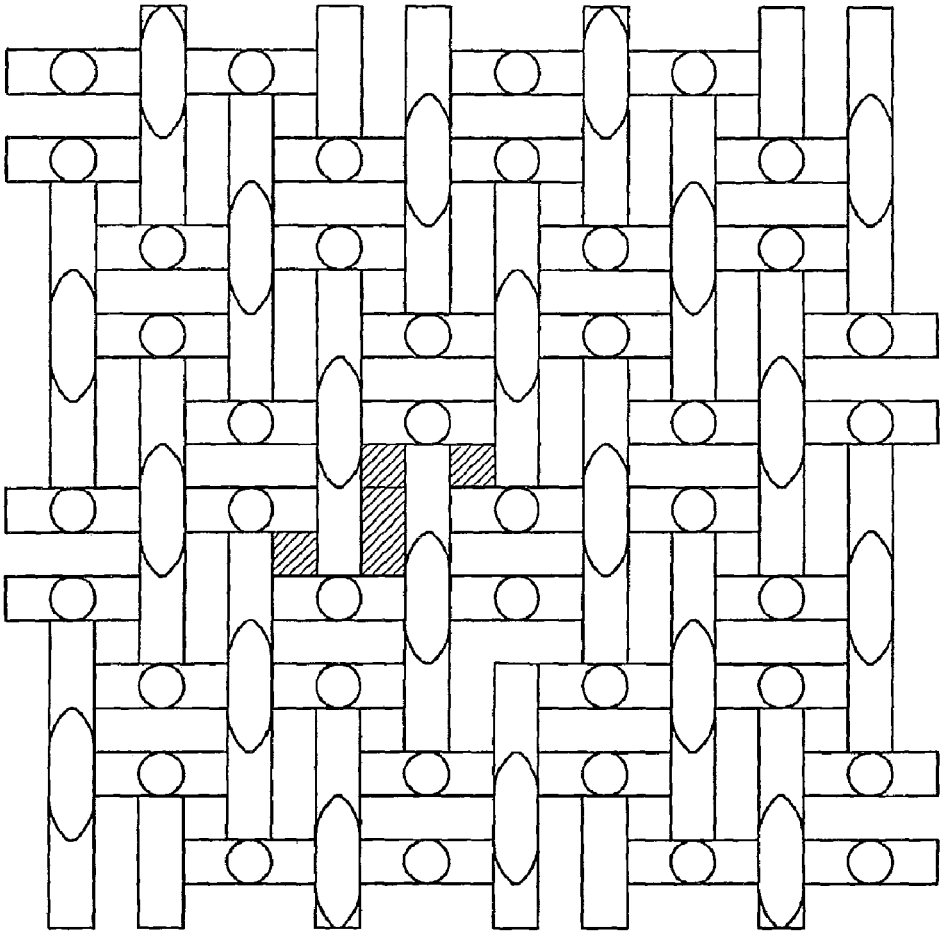
FIG. 22 is a prior art woven fabric known as an G weave fabric.
Figure 23:
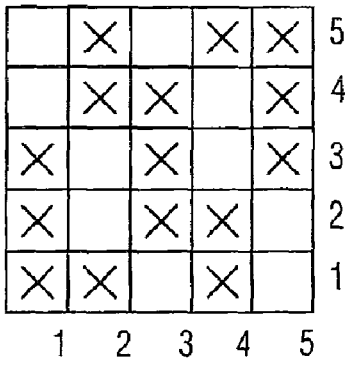
FIG. 23 is a schematical view of the positioning of the weft and warp yarns of the woven fabric of FIG. 22.
Figure 24:
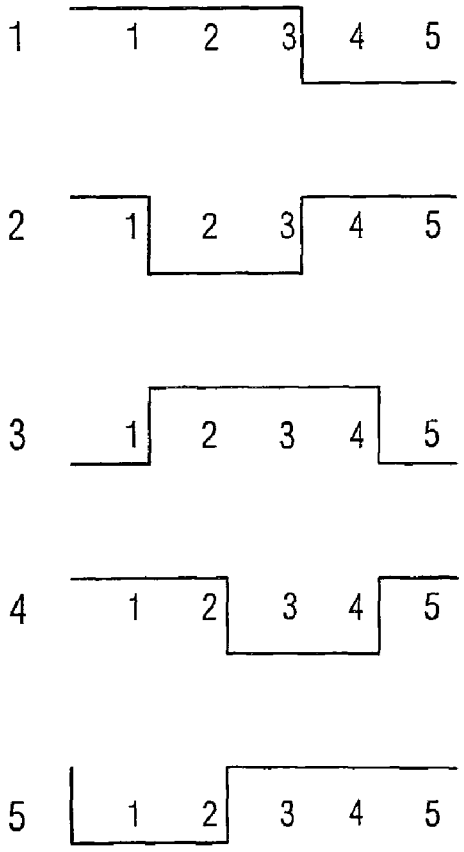
FIG. 24 is a schematical representation of the routing of the warp yarns of the woven fabric of FIGS. 22 and 23.

Now, additionally referring to FIG. 18, a conventional Twin Wire Former 90 may be used to replace the Crescent Former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner forming fabric 91 must be a structured fabric 91 that is much coarser than the outer forming fabric. A vacuum box 92 may be needed to ensure that the web stays with structured wire 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably courser than first structured fabric 91. The process from this point is the same as one of the previously discussed processes. The registration of the web from the first structured fabric to the second structured fabric is not perfect, as such some pillows will lose some basis weight during the expansion process, thereby losing some of the benefit of the present invention. However, this process option allows for running a differential speed transfer, which has been shown to improve some sheet properties.

Any of the arrangements for removing water discussed above as may be used with the Twin Wire Former arrangement and a conventional TAD.

The fiber distribution of web 38 in this invention is opposite that of the prior art, which is a result of removing moisture through the forming fabric and not through the structured fabric. The low density pillow areas are of relatively higher basis weight than the surrounding compressed zones, which is opposite of conventional TAD paper. This allows a high percentage of the fibers to remain uncompressed during the process. The sheet absorbency capacity as measured by the basket method, for a nominal 20 gsm web is equal to or greater than 12 grams water per gram of fiber and often exceeds 15 grams of water per gram fiber. The sheet bulk is equal to or greater than 10 $cm^3$/gm and preferably greater than 13 $cm^3$/gm. The sheet bulk of toilet tissue is expected to be equal to or greater than 13 $cm^3$/gm before calendering.

With the basket method of measuring absorbency, five (5) grams of paper are placed into a basket. The basket containing the paper is then weighted and introduced into a small vessel of water at 20° C. for 60 seconds. After 60 seconds of soak time, the basket is removed from the water and allowed to drain for 60 seconds and then weighted again. The weight difference is then divided by the paper weight to yield the grams of water held per gram of fibers being absorbed and held in the paper.

Web 38 is formed from fibrous slurry 24 that headbox 22 discharges between forming fabric 26 and structured fabric 28. Roll 34 rotates and supports fabrics 26 and 28 as web 38 forms. Moisture M flows through fabric 26 and is captured in save all 36. It is the removal of moisture in this manner that serves to allow pillow areas of web 38 to retain a greater basis weight and therefore thickness than if the moisture were to be removed through structured fabric 28. Sufficient moisture is removed from web 38 to allow fabric 26 to be removed from web 38 to allow web 38 to proceed to a drying stage. Web 38 retains the pattern of structured fabric 28 and any zonal permeability effects from fabric 26 that may be present.

Referring again to FIG. 1, there is shown a papermaking machine 20 including a headbox 22 that discharges a fibrous slurry 24 between forming fabric 26 and a woven structured fabric 28. Rollers 30 and 32 direct fabric 26 in such a manner that tension is applied thereto, against slurry 24 and woven structured fabric 28. Woven structured fabric 28 is supported by forming roll 34, which rotates with a surface speed that matches the speed of woven structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, a structured fibrous web 38 takes form. Moisture M leaves slurry 24 travels through forming fabric 26 and is collected in save-all 36. Fibers in fibrous slurry 24 collect predominately in valleys 28*b* as web 38 takes form.

As slurry 24 comes from headbox 22 it has a very low consistency of approximately 0.1 to 0.5%. The consistency of web 38 increases to approximately 7% at the end of the forming section outlet. Structured fabric 28 carries web 38 from where it is first placed there by headbox 22 all of the way to a Yankee dryer to thereby provide a well defined paper structure for maximum bulk and absorbency capacity. Web 38 has exceptional caliper, bulk and absorbency, 30% higher than with a conventional TAD fabric used for producing paper towels. Excellent transfer of web 38 to the Yankee dryer takes place with the ATMOS™ system working at 33 to 37% dryness, which is a higher moisture content than the TAD of 60 to 75%. There is no dryness loss running in the ATMOS™ configuration, since structured fabric 28 has pocket depth (valleys) and not knuckles (peaks) there is no loss of intimacy between a dewatering fabric, web 38, structured fabric 28 and the belt, which is key to reaching the desired dryness with the ATMOS™ system.

Figures 25, 26:
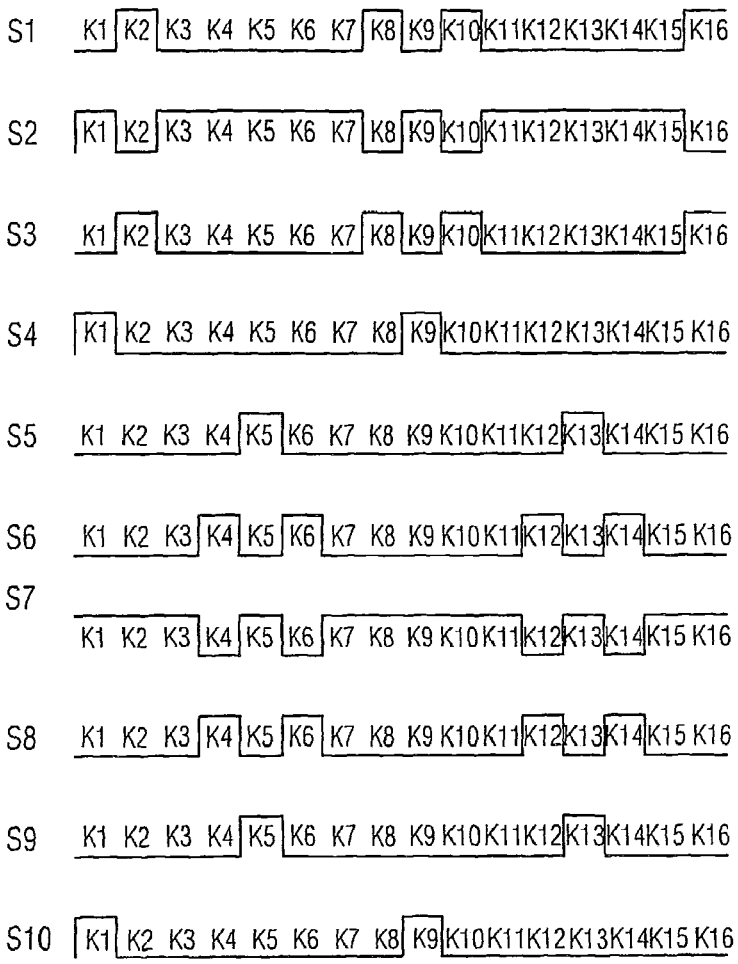
FIG. 25 is an illustration of the weave pattern of a structured papermaking fabric according to the invention as used in FIG. 1.
FIG. 26 is a schematical view of the weft yarns as they cross the warp yarns of the woven fabric of FIGS. 1 and 25.
Figure 27:
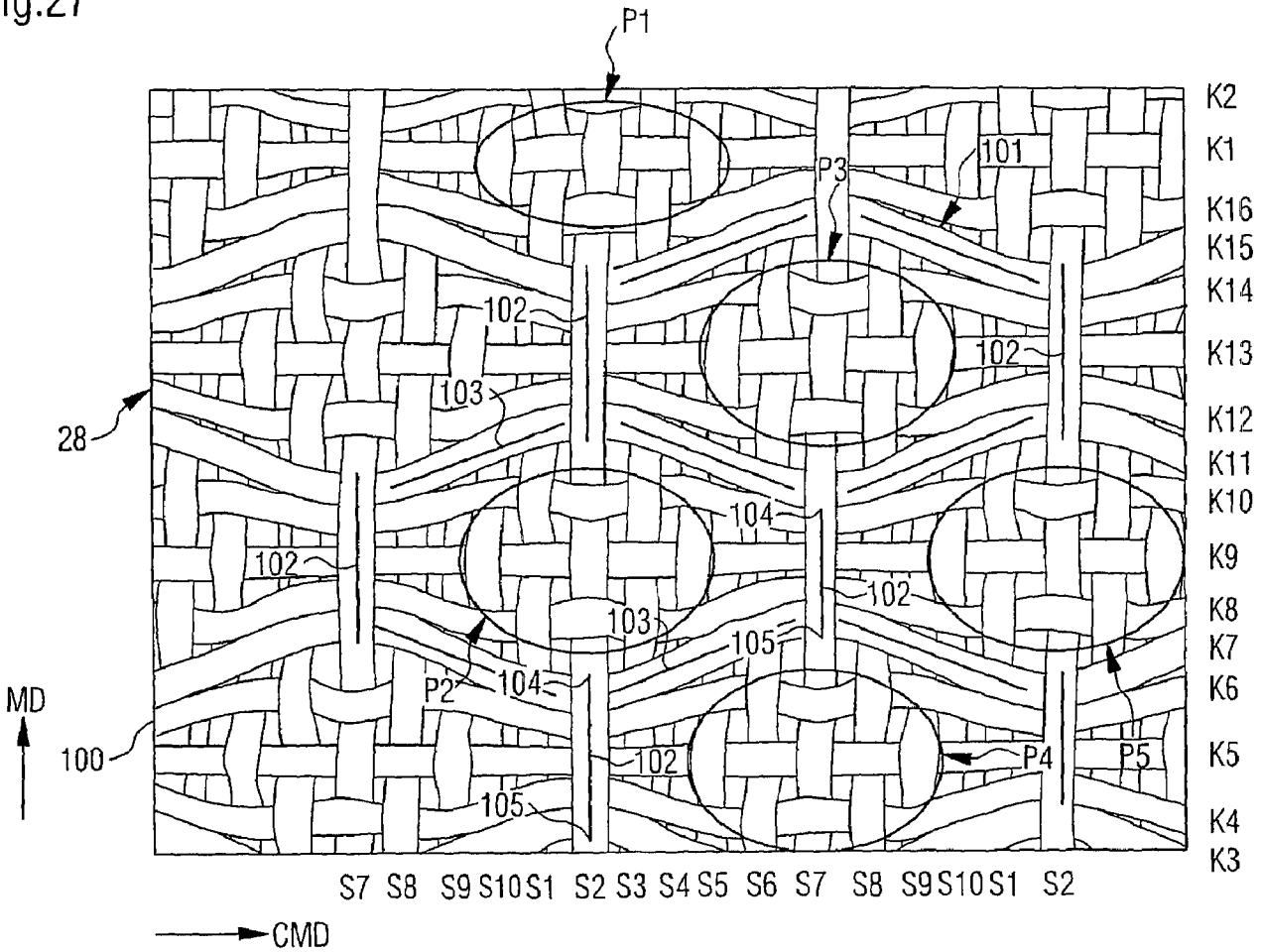
FIG. 27 is a paper side view of the structured fabric of FIGS. 1 and 25-26.

Now, additionally referring to FIGS. 25-27, woven structured papermaking fabric 28 includes per weave repeat unit transverse yarns K1-K16 and longitudinal yarns S1-S10 that are interwoven. The structured papermaking fabric 28 as can be seen in FIGS. 25-27 is a single layer weave. Structured fabric 28 may be woven flat or in endless form. Structured fabric 28 has a surface contact area on the web side of 15 to 40%, preferably 25 to 30% and most preferably approximately 28%.

As can be seen in FIG. 25 the structured papermaking fabric including a web facing side and an opposite side, the web facing side including a pattern formed by the weaving of transverse yarns K1-K16 with longitudinal yarns S1-S10. In the current embodiment the longitudinal yarns S1-S10 are warp yarns and the transverse yarns K1-K16 are weft yarns. Said pattern being repeated in repeat units wherein per repeat unit:

- a first longitudinal yarn S1 passes under a first transverse yarn K1, then passes over a second transverse yarn K2, then passes under the consecutive transverse yarns K3-K7, then passes over the transverse yarn K8, then passes under the transverse yarn K9, then passes over the transverse yarn K10, then passes under the consecutive transverse yarns K11-K15 before passing over the transverse yarn K16,
- a second longitudinal yarn S2 passes over the first transverse yarn K1, then passes under the second transverse yarn K2, then passes over the consecutive transverse yarns K3-K7, then passes under the eighth transverse yarn K8, then passes over the ninth transverse yarn K9, then passes under the tenth transverse yarn K10, then passes over the consecutive transverse yarns K11-K15 before passing under the transverse yarn K16,
- a third longitudinal yarn S3 passes under the first transverse yarn K1, then passes over the second transverse yarn K2, then passes under the consecutive transverse yarns K3-K7, then passes over the eighth transverse yarn K8, then passes under the ninth transverse yarn K9, then passes over the tenth transverse yarn K10, then passes under the consecutive transverse yarns K11-K15 before passing over the sixteenth transverse yarn K16,
- a fourth longitudinal yarn S4 passes over the first transverse yarn K1, then passes under the consecutive transverse yarns K2-K8, then passes over the ninth transverse yarn K9 before passing under the consecutive transverse yarns K10-K16,
- a fifth longitudinal yarn S5 passes under the consecutive transverse yarns K1-K4, then passes over the fifth transverse yarn K5, then passes under the consecutive transverse yarns K6-K12, then passes over the thirteenth transverse yarn K13 before passing under the consecutive transverse yarns K14-K16,
- a sixth longitudinal yarn S6 passes under the consecutive transverse yarns K1-K3, then passes over the fourth transverse yarn K4, then passes under the fifth transverse yarn K5, then passes over the sixth transverse yarn K6, then passes under the consecutive transverse yarns K7-K11, then passes over the twelfth transverse yarn K12, then passes under the thirteenth transverse yarn K13, then passes over the fourteenth transverse yarn K14 before passing under the fifteenth and the sixteenth transverse yarns K15, K16, a seventh longitudinal yarn S7 passes over the consecutive transverse yarns K1-K3, then passes under the fourth transverse yarn K4, then passes over the fifth transverse yarn K5, then passes under the sixth transverse yarn K6, then passes over the consecutive transverse yarns K7-K11, then passes under the twelfth transverse yarn K12, then passes over the thirteenth transverse yarn K13, then passes under the fourteenth transverse yarn K14 before passing over the fifteenth and the sixteenth transverse yarn K15 and K16, an eighth longitudinal yarn S8 passes under the consecutive transverse yarns K1-K3, then passes over the fourth transverse yarn K4, then passes under the fifth transverse yarn K5, then passes over the sixth transverse yarn K6, then passes under the consecutive transverse yarns K7-K11, then passes over the twelfth transverse yarn K12, then passes under the thirteenth transverse yarn K13, then passes over the fourteenth transverse yarn K14 before passing under the fifteenth and the sixteenth transverse yarn K15 and K16, a ninth longitudinal yarn S9 passes under the consecutive transverse yarns K1-K4, then passes over the fifth transverse yarn K5, then passes under the consecutive transverse yarns K6-K12, then passes over the thirteenth transverse yarn K13 before passing under the fourteenth, the fifteenth and sixteenth transverse yarns K14, K15 and K16, a tenth longitudinal yarn S10 passes over the first transverse yarn K1, then passes under the consecutive transverse yarns K2-K8, then passes over the transverse yarn K9, before passing under the consecutive transverse yarns K10-K16.

As can be seen best from FIGS. 26 and 27 the web facing side 100 of the papermaking fabric 28 includes a structure formed by interweaving of the transverse yarns K1-K16 with the longitudinal yarns S1-S10. The structure includes a plurality of pattern areas P1-P5. Said pattern areas P1-P5 are regularly distributed on the web facing side 100. Each of said pattern areas P1-P5 is surrounded by an edge area 101. The pattern areas P1-P5 are woven in a plain weave. Each of the edge areas 101 includes at least one longitudinal edge segment 102 and at least one transverse edge segment 103. The longitudinal edge segments 102 are formed by weaving of a longitudinal yarn e.g. S2, S7 over five consecutive transverse yarns e.g. K11-K15 or K7-K11 or K3-K7.

By way of example a longitudinal edge segment 102 is formed by weaving of the longitudinal yarns S2 over the consecutive transverse yarns K11-K15. Another longitudinal edge segment 102 is formed by weaving of the longitudinal yarns S7 over the consecutive transverse yarns K7-K11.

The transverse edge segments 103 are formed by weaving of a transverse yarn e.g. K7 or K11 over four consecutive longitudinal yarns e.g. S8-S1 or S3-S6.

In the embodiment shown in the FIGS. 25-27 an edge area 101 includes six edge segments 102, 103. Said six edge segments 102, 103 are in a hexagonal arrangement such that each of the pattern areas P1-P5 is surrounded by a hexagonal edge area 101.

As can be seen from FIG. 27 the hexagonal edge area 101 includes four transverse edge segments 103 and two longitudinal edge segments 102.

The pattern areas P1-P5 and the edge areas 101 provide a three-dimensional structure on the web facing side 100 of the papermaking fabric 28.

As can be seen best from FIG. 26 the pattern areas P1-P5 are woven such that each of it describes a rhombus or a square on the web facing side 100.

Further the pattern areas P1-P5 are arranged in a plurality of parallel rows, which extend in the direction of the longitudinal yarns. By way of example pattern areas P1 and P2 are arranged in a row extending along longitudinal yarn S2, whereas pattern areas P3 and P4 are arranged in a row extending along longitudinal yarn S7.

The pattern areas arranged in adjacent rows have an offset in the longitudinal yarn direction in relation to each other. By way of example pattern area P2 along row S2 has an offset of four transverse yarns K10-K13 in relation to pattern area P3 along the adjacent row S7.

The longitudinal edge segments 102 of adjacent rows have an offset in the longitudinal direction in relation to each other.

As can be seen from FIG. 27 each of the longitudinal edge segments 102 extends from a lower end 105 to an upper end 104. Thereby a longitudinal yarn first passes over a lower end transverse yarn to define the lower end 105, then passes over a plurality of consecutive transverse yarns before finally passing over an upper end transverse yarn to define the upper end 104. The offset of adjacent longitudinal edge segments 102 from adjacent rows is such that adjacent longitudinal edge segments from adjacent rows have a common transverse yarn, wherein said common transverse yarn is the upper end transverse yarn of the longitudinal edge segment from a row and wherein said common transverse yarn is the lower end transverse yarn of the adjacent longitudinal edge segment from the adjacent row.

By way of example the offset of adjacent longitudinal edge segments 102 and 102' of adjacent rows e.g. S2 and S7 is such that adjacent longitudinal edge segments 102' and 102 of adjacent rows S2, S7 have a common transverse yarn e.g. K7, wherein the common transverse yarn K7 is the upper end 104 transverse yarn of the longitudinal edge segment 102' from row S2 and wherein the common transverse K7 is the lower end 105 transverse yarn of the adjacent longitudinal edge segment 102 from the adjacent row S7.

Further each row of pattern areas has an adjacent row of pattern areas disposed on each side of said row of pattern areas. The pattern areas of said first and said second row have an offset in the longitudinal direction in relation to the pattern areas of said row. The pattern areas of said first and said second row have no offset in the longitudinal direction in relation to each other. By way of example pattern areas P3, P4 are arranged along row S7. Row S7 has adjacent rows S2 on each side with pattern areas P1, P2 and P5. Pattern areas P1, P2 and P5 of rows S2 have an offset of four transverse yarns in relation to pattern areas P3, P4 of row S7, but have no offset in the longitudinal direction in relation to each other.

The pattern areas P1-P5 are formed by the interweaving of an uneven number of longitudinal yarns with an uneven number of transverse yarns. More concrete the pattern areas P1-P5 are formed by the interweaving of three longitudinal yarns e.g. S1-S3 with three transverse yarns e.g. K8-K10.

Each of the plain weave pattern areas P1-P5 includes a mid position longitudinal yarn e.g. S2, S7. The mid position longitudinal yarns S2, S7 have the same number of longitudinal yarns on each side—e.g. S10, S1 on the one side of S2 and S3, S4 on the other side of S2—that weaves the pattern area e.g. P2, P5. As can be seen each of the mid position longitudinal yarns S2, S7 alternately weave in the following sequence:

over at least five consecutive transverse yarns to form a longitudinal edge segment, then in a plain weave manner with at least three consecutive transverse yarns to form a part of the pattern area.

By way of example mid-position longitudinal yarn S2 weaves over the consecutive transverse yarns K3-K7 to form longitudinal edge segment 102' and then weaves in a plain weave manner with the three consecutive transverse yarns K8-K9 to form a part of the pattern area P2.

Further each of the plain weave pattern areas P1-P5 includes a mid-position transverse yarn, e.g. K1, K5, K9, K13, each of which has the same number of transverse yarns on each side, that weaves the pattern area.

By way of example mid position transverse yarn K9 has on each side one transverse yarn, namely the transverse yarn K10 on the one side and the other transverse yarn K8 on the other side, which also weave the pattern area P5 or P3.

Each of the mid-position transverse yarns alternately weave in the following sequence:

in a plain weave manner with at least three, preferably five, consecutive longitudinal yarns to form a part of the pattern area, then over at least two, under one and over at least two consecutive longitudinal yarns.

By way of example mid position transverse yarn K9 repeatingly weaves in a plain weave manner with the five consecutive longitudinal yarns S10, S1-S4 to form a part of the pattern area P2, then weaves over the two consecutive longitudinal yarns S5 and S6, then weaves under one longitudinal yarn S7 before weaving over the two consecutive longitudinal yarns S8 and S9.

As can be seen from FIG. 27 there are four other longitudinal yarns which are located between consecutive mid-position longitudinal yarns. By way of example longitudinal yarns S3-S6 are located between the two consecutive mid-position longitudinal yarns S2 and S7. Further on all pattern areas 101 arranged in a longitudinal direction row have the same mid-position longitudinal yarn. E.g. the pattern areas P1 and P2, which are arranged in one row have the same mid-position longitudinal yarn S2.

Further on between consecutive mid-position transverse yarns three other transverse yarns are located. By way of example transverse yarns K10-K12 are located between two consecutive mid-position longitudinal yarns K9 and K13.

Further the weave structure includes first transverse yarns e.g. K8-K10 and second transverse yarns e.g. K7 and K11, said first transverse yarns e.g. K8-K10 weaving a pattern area, e.g. P2 or P5, said second transverse yarns e.g. K7 and K11 weaving a transverse edge segment 103, and said first and said second transverse yarns K7-K11 together weaving with a longitudinal yarn S7 a longitudinal edge segment 102.

By way of example first transverse yarns K8-K10 first weave with the longitudinal yarns S10, S1-S5 the pattern area P2. Further each of the second transverse yarns K7 and K11 interweaves with longitudinal yarns S3-S6 to form a transverse edge segment 103. In addition transverse yarns K7-K11 weave with longitudinal yarn S7 to form the edge segment 102.

As can be seen from FIG. 27 the number of transverse yarns K8-K10 per cm is lower when the transverse yarns K8-K10 weave the pattern area P2, P5 in comparison to the number of the same transverse yarns K8-K10 per cm, when they weave under the same longitudinal yarn e.g. S7 to form a longitudinal edge segment 102.

Further the number of the longitudinal yarns S1-S10 per cm is substantially the same all over the paper facing side 100 of the fabric 28.

Further each of said pattern areas provides a pocket, each of said pockets having a pocket volume of from approximately 1 $mm^3$ to approximately 20 $mm^3$, preferably from approximately 2 $mm^3$ to approximately 10 $mm^3$.

The pockets have a pocket density of from approximately 10 to approximately 150 pockets per square inch, preferably from approximately 25 to approximately 100 pockets per square inch, across a surface of said papermaking fabric.

As can be seen from FIG. 27 the longitudinal yarns S1-S10 extend in the machine direction (MD) and the transverse yarns K1-K16 extend in the cross machine direction (CMD) of said papermaking fabric.

The permeability of woven structured fabric 28 is between 300 cfm (cubic feet per minute) and 1,600 cfm, with a preferred range of 500 cfm to 1,000 cfm, and a most preferred value of approximately 750 cfm.

Structured papermaking fabric 28 has a surface contact area in the range of 15 to 40%, with a preferred range of 25 to 30%, and a most preferred value of approximately 28%. The thickness of structured fabric 28 is in the range of 0.03 to 0.08 inches and preferably 0.04 to 0.06 inches, with a most preferred value of 0.05 inches.

As previously mentioned, the pockets are deeper than those of the prior art because they are on a plane lower than the contact level that surrounds each of these pockets. The use of woven structured fabric 28 with a papermaking machine 20, as illustrated in FIGS. 12-18, is directed to a molding position on an ATMOS™ system, but may also find use on a conventional TAD, a transfer position on an E-TAD or a position on a Metso concept machine.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A structured papermaking fabric for making a bulky tissue web, said structured papermaking fabric comprising:

a plurality of longitudinal yarns;

a plurality of transverse yarns;

a web-facing side; and a side opposing said web-facing side, said web-facing side including a structure including said plurality of transverse yarns interweaving with said plurality of longitudinal yarns, said structure including a plurality of pattern areas which are regularly distributed on said web-facing side, each of said plurality of pattern areas being surrounded by an edge area and being woven in a plain weave, each said edge area including at least one longitudinal edge segment and at least one transverse edge segment, said at least one longitudinal edge segment including one of said plurality of longitudinal yarns weaving over at least four consecutive ones of said plurality of transverse yarns, said at least one transverse edge segment including one of said plurality of transverse yarns weaving over at least four consecutive ones of said plurality of longitudinal yarns, said plurality of transverse yarns including first transverse yarns and second transverse yarns, said structure being a weave structure including said first transverse yarns and said second transverse yarns, said first transverse yarns weaving a respective one of said plurality of pattern areas, each of said second transverse yarns weaving a respective said transverse edge segment, said first and said second transverse yarns together weaving with a respective one of said plurality of longitudinal yarns to form a respective said longitudinal edge segment, said respective one of said plurality of longitudinal yarns thereby passing over said first transverse yarns and said second transverse yarns to form said respective longitudinal edge segment.

2. The structured papermaking fabric according to claim 1, wherein said at least one longitudinal edge segment includes said one of said plurality of longitudinal yarns weaving over at least five consecutive ones of said plurality of transverse yarns.

3. The structured papermaking fabric according to claim 1, wherein each said edge area includes six edge segments including said at least one longitudinal edge segment and said at least one transverse edge segment, said six edge segments of each said edge area being in a hexagonal arrangement which surrounds one of said plurality of pattern areas.

4. The structured papermaking fabric according to claim 3, wherein said hexagonal arrangement includes four of said transverse edge segment and two of said longitudinal edge segment.

5. The structured papermaking fabric according to claim 1, wherein said plurality of pattern areas are woven such that each of said plurality of pattern areas describes one of a rhombus and a square on said web-facing side.

6. The structured papermaking fabric according to claim 1, wherein said plurality of pattern areas are arranged in a plurality of parallel rows.

7. The structured papermaking fabric according to claim 6, wherein each of said plurality of parallel rows extends in a direction of said plurality of longitudinal yarns.

8. The structured papermaking fabric according to claim 6, wherein respective ones of said plurality of pattern areas which are arranged in adjacent ones of said plurality of parallel rows have an offset in a longitudinal direction in relation to each other.

9. The structured papermaking fabric according to claim 6, wherein at least one said row of pattern areas includes a first side and a second side and has a first adjacent said row of pattern areas disposed on said first side and a second adjacent said row of pattern areas disposed on said second side, said pattern areas of said at least one row of pattern areas being offset in a longitudinal direction relative to (a) said pattern areas of said first adjacent row of pattern areas and (b) said pattern areas of said second adjacent row of pattern areas, said pattern areas of said first adjacent row of pattern areas having no offset in said longitudinal direction relative to said pattern areas of said second adjacent row of pattern areas.

10. The structured papermaking fabric according to claim 1, wherein each of said plurality of pattern areas includes an uneven number of said plurality of longitudinal yarns interweaving with an uneven number of said plurality of transverse yarns.

11. The structured papermaking fabric according to claim 1, wherein each of said plurality of pattern areas includes at least three of said plurality of longitudinal yarns interweaving with at least three of said plurality of transverse yarns.

12. The structured papermaking fabric according to claim 1, wherein each of said plurality of pattern areas includes a mid-position longitudinal yarn having a same number of said plurality of longitudinal yarns on each side of said mid-position longitudinal yarn that weaves a respective said pattern area, said mid-position longitudinal yarn alternately weaving (a) over at least five consecutive ones of said plurality of transverse yarns to form said longitudinal edge segment and (b) then in a plain weave manner with at least three consecutive ones of said plurality of transverse yarns to form a part of said respective pattern area.

13. The structured papermaking fabric according to claim 12, wherein each of said plurality of pattern areas includes a mid-position transverse yarn having a same number of said plurality of transverse yarns on each side of said mid-position transverse yarn that weaves said respective pattern area, said mid-position transverse yarn alternately weaving (a) in said plain weave manner with at least three consecutive ones of said plurality of longitudinal yarns to form a part of said respective pattern area and (b) then over at least two consecutive ones of said plurality of longitudinal yarns, under one of said plurality of longitudinal yarns, and over at least two consecutive ones of said plurality of longitudinal yarns.

14. The structured papermaking fabric according to claim 12, wherein each of said plurality of pattern areas includes a mid-position transverse yarn having a same number of said plurality of transverse yarns on each side of said mid-position transverse yarn that weaves said respective pattern area, said mid-position transverse yarn alternately weaving (a) in said plain weave manner with at least five consecutive ones of said plurality of longitudinal yarns to form a part of said respective pattern area and (b) then over at least two consecutive ones of said plurality of longitudinal yarns, under one of said plurality of longitudinal yarns, and over at least two consecutive ones of said plurality of longitudinal yarns.

15. The structured papermaking fabric according to claim 14, wherein said plurality of longitudinal yarns includes consecutive ones of said mid-position longitudinal yarn and four other said longitudinal yarns therebetween.

16. The structured papermaking fabric according to claim 14, wherein said plurality of pattern areas are arranged in a plurality of parallel rows, all of said plurality of pattern areas which are arranged in a respective one of said plurality of parallel rows have a same said mid-position longitudinal yarn.

17. The structured papermaking fabric according to claim 16, wherein said plurality of transverse yarns includes consecutive ones of said mid-position transverse yarn and three other said transverse yarns therebetween.

18. The structured papermaking fabric according to claim 1, wherein a number of said plurality of transverse yarns per centimeter is lower when respective ones of said plurality of transverse yarns weave a respective one of said pattern areas in comparison to a density of said plurality of transverse yarns when the same said respective ones of said plurality of transverse yarns weave with a respective one of said plurality of longitudinal yarns to form a respective said longitudinal edge segment.

19. The structured papermaking fabric according to claim 1, wherein a density of said plurality of longitudinal yarns per centimeter is substantially the same all over said web-facing side of the structured papermaking fabric.

20. The structured papermaking fabric according to claim 1, wherein the structured papermaking fabric is a single layer fabric.

21. A structured papermaking fabric for making a bulky tissue web, said structured papermaking fabric comprising:

a plurality of longitudinal yarns including a first longitudinal yarn, a second longitudinal yarn, a third longitudinal yarn, a fourth longitudinal yarn, a fifth longitudinal yarn, a sixth longitudinal yarn, a seventh longitudinal yarn, an eighth longitudinal yarn, a ninth longitudinal yarn, and a tenth longitudinal yarn;

a plurality of transverse yarns including a first transverse yarn, a second transverse yarn, a third transverse yarn, a fourth transverse yarn, a fifth transverse yarn, a sixth transverse yarn, a seventh transverse yarn, an eighth transverse yarn, a ninth transverse yarn, a tenth transverse yarn, an eleventh transverse yarn, a twelfth transverse yarn, a thirteenth transverse yarn, a fourteenth transverse yarn, a fifteenth transverse yarn, and a sixteenth transverse yarn;

a web facing side; and a side opposing said web-facing side, said web-facing side including a pattern including said plurality of transverse yarns weaving with said plurality of longitudinal yarns, said pattern being repeated in a plurality of repeat units, each of said plurality of repeat units including:

(a) said first longitudinal yarn passing under said first transverse yarn, then passing over said second transverse yarn, then passing under said third, fourth, fifth, sixth, and seventh transverse yarns, then passing over said eighth transverse yarn, then passing under said ninth transverse yarn, then passing over said tenth transverse yarn, then passing under said eleventh, twelfth, thirteenth, fourteenth, and fifteenth transverse yarns before passing over said sixteenth transverse yarn;

(b) said second longitudinal yarn passing over said first transverse yarn, then passing under said second transverse yarn, then passing over said third, fourth, fifth, sixth, and seventh transverse yarns, then passing under said eighth transverse yarn, then passing over said ninth transverse yarn, then passing under said tenth transverse yarn, then passing over said eleventh, twelfth, thirteenth, fourteenth, and fifteenth transverse yarns before passing under said sixteenth transverse yarn;

(c) said third longitudinal yarn passing under said first transverse yarn, then passing over said second transverse yarn, then passing under said third, fourth, fifth, sixth, and seventh transverse yarns, then passing over said eighth transverse yarn, then passing under said ninth transverse yarn, then passing over said tenth transverse yarn, then passing under said eleventh, twelfth, thirteenth, fourteenth, and fifteenth transverse yarns before passing over said sixteenth transverse yarn;

(d) said fourth longitudinal yarn passing over said first transverse yarn, then passing under said second, third, fourth, fifth, sixth, seventh, and eighth transverse yarns, then passing over said ninth transverse yarn before passing under said tenth, eleventh, twelfth, thirteenth, fourteenth, fifteenth, and sixteenth transverse yarns;

(e) said fifth longitudinal yarn passing under said first, second, third, and fourth transverse yarns, then passing over said fifth transverse yarn, then passing under said sixth, seventh, eighth, ninth, tenth, eleventh, and twelfth transverse yarns, then passing over said thirteenth transverse yarn before passing under said fourteenth, fifteenth, and sixteenth transverse yarns;

(f) said sixth longitudinal yarn passing under said first, second, and third transverse yarns, then passing over said fourth transverse yarn, then passing under said fifth transverse yarn, then passing over said sixth transverse yarn, then passing under said seventh, eighth, ninth, tenth, and eleventh transverse yarns, then passing over said twelfth transverse yarn, then passing under said thirteenth transverse yarn, then passing over said fourteenth transverse yarn before passing under said fifteenth and sixteenth transverse yarns;

(g) said seventh longitudinal yarn passing over said first, second, and third transverse yarns, then passing under said fourth transverse yarn, then passing over said fifth transverse yarn, then passing under said sixth transverse yarn, then passing over said seventh, eighth, ninth, tenth, and eleventh transverse yarns, then passing under said twelfth transverse yarn, then passing over said thirteenth transverse yarn, then passing under said fourteenth transverse yarn before passing over said fifteenth and sixteenth transverse yarns;

(h) said eighth longitudinal yarn passing under said first, second, and third transverse yarns, then passing over said fourth transverse yarn, then passing under said fifth transverse yarn, then passing over said sixth transverse yarn, then passing under said seventh, eighth, ninth, tenth, and eleventh transverse yarns, then passing over said twelfth transverse yarn, then passing under said thirteenth transverse yarn, then passing over said fourteenth transverse yarn before passing under said fifteenth and sixteenth transverse yarns;

(i) said ninth longitudinal yarn passing under said first, second, third, and fourth transverse yarns, then passing over said fifth transverse yarn, then passing under said sixth, seventh, eighth, ninth, tenth, eleventh, and twelfth transverse yarns, then passing over said thirteenth transverse yarn before passing under said fourteenth, fifteenth, and sixteenth transverse yarns; and (j) said tenth longitudinal yarn passing over said first transverse yarn, then passing under said second, third, fourth, fifth, sixth, seventh, and eighth transverse yarns, then passing over said ninth transverse yarns before passing under said tenth, eleventh, twelfth, thirteenth, fourteenth, fifteenth, and sixteenth transverse yarns.

22. The structured papermaking fabric according to claim 21, wherein said pattern includes a plurality of pattern areas which are regularly distributed on said web-facing side, each of said plurality of pattern areas including a pocket having a pocket volume of from approximately 1 $mm^3$ to approximately 20 $mm^3$.

23. The structured papermaking fabric according to claim 22, wherein each of said plurality of pattern areas includes a pocket having a pocket volume of from approximately 2 $mm^3$ to approximately 10 $mm^3$.

24. The structured papermaking fabric according to claim 22, further including a surface, each said pocket having a pocket density of from approximately 10 to approximately 150 pockets per square inch across said surface of the structured papermaking fabric.

25. The structured papermaking fabric according to claim 22, further including a surface, each said pocket having a pocket density of from approximately 25 to approximately 100 pockets per square inch across said surface of the structured papermaking fabric.

26. The structured papermaking fabric according to claim 21, wherein the structured papermaking fabric has a thickness of from approximately 0.03 inch to approximately 0.08 inch.

27. The structured papermaking fabric according to claim 21, wherein the structured papermaking fabric has a permeability of between 300 cfm and 1,600 cfm.

28. The structured papermaking fabric according to claim 21, wherein each of said plurality of repeat units includes at least one pocket.

29. The structured papermaking fabric according to claim 21, wherein said plurality of longitudinal yarns extend in a machine direction of the structured papermaking fabric and said plurality of transverse yarns extend in a cross machine direction of the structured papermaking fabric.

30. The structured papermaking fabric according to claim 21, wherein the structured papermaking fabric is a Through-Air-Drying fabric.

31. The structured papermaking fabric according to claim 21, wherein said pattern includes a plurality of pattern areas which are regularly distributed on said web-facing side, each of said plurality of pattern areas being surrounded by an edge area, each said pattern area and each said edge area providing a three-dimensional structure on said web-facing side of the structured papermaking fabric.

32. A papermaking machine, comprising:

a belt press including a roll, a permeable belt, and at least one structured papermaking fabric, said roll including an exterior surface, said permeable belt including a first side, being guided over a portion of said exterior surface of said roll, and having a tension of at least approximately 30 KN/m, said first side of said permeable belt having a contact area of at least 10%, said at least one structured papermaking fabric including:

(a) a plurality of longitudinal yarns;

(b) a plurality of transverse yarns;

(c) a web-facing side; and (d) a side opposing said web-facing side, said web-facing side including a structure including said plurality of transverse yarns interweaving with said plurality of longitudinal yarns, said structure including a plurality of pattern areas which are regularly distributed on said web-facing side, each of said plurality of pattern areas being surrounded by an edge area and being woven in a plain weave, each said edge area including at least one longitudinal edge segment and at least one transverse edge segment, said at least one longitudinal edge segment including one of said plurality of longitudinal yarns weaving over at least four consecutive ones of said plurality of transverse yarns, said at least one transverse edge segment including one of said plurality of transverse yarns weaving over at least four consecutive ones of said plurality of longitudinal yarns.

33. The papermaking machine of claim 32, wherein said contact area of said permeable belt is at least 25%.

34. The papermaking machine of claim 32, further including another fabric, said structured papermaking fabric and said other fabric traveling between said permeable belt and said roll, said other fabric having a first side and a second side, said first side of said other fabric being in at least partial contact with said exterior surface of said roll, said second side of said other fabric being in at least partial contact with a first side of a web of fibrous material, said side of said structured papermaking fabric opposing said web-facing side being in at least partial contact with said first side of said permeable belt, said web-facing side of said structured papermaking fabric being in at least partial contact with a second side of said web of fibrous material.

35. The papermaking machine of claim 34, wherein said other fabric is one of a permeable dewatering belt, a felt with at least one belt layer, a woven fabric, and a wire.

36. The papermaking machine of claim 34, wherein said web of fibrous material is a tissue web.

37. The papermaking machine according to claim 36, wherein said tissue web is formed on said structured papermaking fabric.

38. A method of subjecting a web of fibrous material to pressing in a papermaking machine, said method comprising the steps of:

providing a structured papermaking fabric including:

(a) a plurality of longitudinal yarns;

(b) a plurality of transverse yarns;

(c) a web-facing side; and (d) a side opposing said web-facing side, said web-facing side including a structure including said plurality of transverse yarns interweaving with said plurality of longitudinal yarns, said structure including a plurality of pattern areas which are regularly distributed on said web-facing side, each of said plurality of pattern areas being surrounded by an edge area and being woven in a plain weave, each said edge area including at least one longitudinal edge segment and at least one transverse edge segment, said at least one longitudinal edge segment including one of said plurality of longitudinal yarns weaving over at least four consecutive ones of said plurality of transverse yarns, said at least one transverse edge segment including one of said plurality of transverse yarns weaving over at least four consecutive ones of said plurality of longitudinal yarns;

carrying the web on said structured papermaking fabric;

applying pressure against a contact area of the web with a portion of a permeable belt, said contact area being at least 10%; and moving air through an open area of said permeable belt and through the web, said permeable belt having a tension of at least 30 kN/m, said web-facing side of said structured papermaking fabric being in at least partial contact with a portion of the web.

39. The method of claim 38, wherein said permeable belt has an open area of at least 25%.

40. The method of claim 38, wherein said portion of said permeable belt includes a contact area, said contact area of said permeable belt being at least 25%.

41. The method of claim 38, wherein said contact area of the web includes a first plurality of areas that are pressed more by said portion of said permeable belt than a second plurality of areas apart from said portion of said permeable belt.

42. The method of claim 41, wherein said portion of said permeable belt includes a generally planar surface having no openings, no recesses, and no grooves, said permeable belt being guided over a roll.

43. The method of claim 38, further comprising the steps of:

forming the web on said structured papermaking fabric; and conveying the web on said structured papermaking fabric until the web is transferred to a Yankee dryer.

44. A pressing arrangement for use in a papermaking machine, said pressing arrangement comprising:

a permeable first fabric, said permeable first fabric being a structured papermaking fabric including:

(a) a plurality of longitudinal yarns;

(b) a plurality of transverse yarns;

(c) a web-facing side; and (d) a side opposing said web-facing side, said web-facing side including a structure including said plurality of transverse yarns interweaving with said plurality of longitudinal yarns, said structure including a plurality of pattern areas which are regularly distributed on said web-facing side, each of said plurality of pattern areas being surrounded by an edge area and being woven in a plain weave, each said edge area including at least one longitudinal edge segment and at least one transverse edge segment, said at least one longitudinal edge segment including one of said plurality of longitudinal yarns weaving over at least four consecutive ones of said plurality of transverse yarns, said at least one transverse edge segment including one of said plurality of transverse yarns weaving over at least four consecutive ones of said plurality of longitudinal yarns;

a permeable second fabric, a paper web being disposed between said permeable first fabric and said permeable second fabric;

a pressure producing element being in contact with said permeable first fabric;

a supporting structure including a support surface in contact with said permeable second fabric; and a differential pressure arrangement providing a differential pressure between said permeable first fabric and said support surface, said differential pressure acting on at least one of said permeable first fabric, said paper web, and said permeable second fabric, said pressing arrangement being configured for subjecting said paper web to a mechanical pressure and to a hydraulic pressure to drain water from said paper web, said pressing arrangement being configured for allowing air to flow in a direction through said permeable first fabric, said paper web, and said permeable second fabric.

45. The pressing arrangement of claim 44, wherein said permeable second fabric includes at least one of a felt and a batt layer.

* * * * *